US012037855B2

(12) United States Patent
Little et al.

(10) Patent No.: US 12,037,855 B2
(45) Date of Patent: Jul. 16, 2024

(54) ROD HANDLING SYSTEM FOR DRILLING RIGS

(71) Applicant: Evolution Drill Rigs Pty Ltd, Richlands (AU)

(72) Inventors: Graham Patrick Little, Richlands (AU); Keith William Flanders, Richlands (AU)

(73) Assignee: Evolution Drill Rigs Pty Ltd, Richlands (AU)

( * ) Notice: Subject to any disclaimer, the term of this patent is extended or adjusted under 35 U.S.C. 154(b) by 0 days.

(21) Appl. No.: 18/253,600

(22) PCT Filed: Nov. 18, 2021

(86) PCT No.: PCT/AU2021/051376
§ 371 (c)(1),
(2) Date: May 19, 2023

(87) PCT Pub. No.: WO2022/104426
PCT Pub. Date: May 27, 2022

(65) Prior Publication Data

US 2023/0323743 A1 Oct. 12, 2023

(30) Foreign Application Priority Data

Nov. 20, 2020 (AU) ..... 2020904294

(51) Int. Cl.
*E21B 19/20* (2006.01)
*E21B 19/15* (2006.01)

(52) U.S. Cl.
CPC ..... *E21B 19/20* (2013.01); *E21B 19/155* (2013.01)

(58) Field of Classification Search
CPC ..... E21B 19/20; E21B 19/155
See application file for complete search history.

(56) References Cited

U.S. PATENT DOCUMENTS 3,651,959 A 3/1972 Castela et al.
4,347,028 A * 8/1982 Dugan ..... E21B 19/155 414/22.61

(Continued)

FOREIGN PATENT DOCUMENTS

| | | |
|---|---|---|
| CA | 2720802 A1 | 5/2012 |
| GB | 2264736 | 9/1993 |
| JP | S6051291 A | 3/1985 |

OTHER PUBLICATIONS

Australian Patent Office; International Preliminary Report on Patentability for PCT/AU2021/051376; Oct. 28, 2022; entire document.

(Continued)

*Primary Examiner* — Taras P Bemko
(74) *Attorney, Agent, or Firm* — Allen, Dyer, Doppelt & Gilchrist, P.A.

(57) ABSTRACT

The present invention relates to a rod handling apparatus for a drill rig including a drill rig mast and a hoisting winch. The rod handling apparatus including: a base assembly; a frame assembly coupled to the base assembly, the frame assembly including a pair of rails along which a conveyor assembly is adapted to travel along; and, the conveyor assembly adapted to be coupled to the hoisting winch for conveying a drill rod up and/or down the drill rig mast such that the drill rod is attachable to and/or detachable from a drill string.

20 Claims, 28 Drawing Sheets

(56) References Cited

U.S. PATENT DOCUMENTS

| | | | | |
|---|---|---|---|---|
| 4,725,179 | A | 2/1988 | Woolslayer et al. | |
| 6,533,519 | B1 * | 3/2003 | Tolmon | E21B 19/155 414/22.58 |
| 6,695,559 | B1 * | 2/2004 | Pietras | E21B 19/20 414/22.58 |
| 10,060,203 | B2 * | 8/2018 | Dore | E21B 19/15 |
| 10,612,322 | B2 | 4/2020 | Doyon | |
| 11,434,705 | B2 * | 9/2022 | Hansen | E21B 19/165 |
| 2003/0159854 | A1 | 8/2003 | Simpson et al. | |
| 2005/0152772 | A1 * | 7/2005 | Hawkins | E21B 19/155 414/22.59 |
| 2005/0173154 | A1 * | 8/2005 | Lesko | E21B 19/20 175/57 |
| 2006/0285941 | A1 * | 12/2006 | Fikowski | E21B 19/155 414/22.54 |
| 2010/0135750 | A1 * | 6/2010 | Tarique | E21B 19/20 414/800 |
| 2012/0121364 | A1 * | 5/2012 | Taggart | E21B 19/155 414/800 |
| 2018/0179834 | A1 * | 6/2018 | Gordon | E21B 19/20 |
| 2019/0003271 | A1 * | 1/2019 | Clarke | E21B 19/155 |
| 2022/0003055 | A1 * | 1/2022 | Petrello | E21B 19/087 |

OTHER PUBLICATIONS

Australian Patent Office; International Search Report and Written Opinion for PCT/AU2021/051376; Feb. 2, 2022; entire document.
European Patent Office; Extended European Search Report for Application No. EP21893144.2; Apr. 16, 2024; Entire document.

* cited by examiner

ROD HANDLING SYSTEM FOR DRILLING RIGS

TECHNICAL FIELD

The present invention relates drill rigs. In particular, a rod handling system for drill rigs used in exploration drilling.

BACKGROUND

Drill rigs form part of an integrated system used for drilling holes, for example, mineral exploration, water, oil and gas, as well as other applications. Common to all drill rigs is a drill string which connects the rig to a drilling bit, or pneumatic hammer, used to penetrate the earth. The drill string is made up of drill pipe or rod segments which are screwed together. Typically, the drill pipe segments are made up of one or more drill rods. Drill pipe segments vary in length depending upon the application. To handle the drill pipe segments, into or from the rig, a hoisting winch is used.

One common type of exploration drill rigs is a multi-purpose drill rig. Multi-purpose drill rigs differ from specific-purpose drill rigs in their capacity to perform diamond core, standard rotary hammer or reverse circulation drilling.

The most time-consuming drilling program is deep diamond core drilling. Deep diamond core drilling is commonly performed with mast inclinations of 90 degrees to 45 degrees. Typically, drill rig practice involves drawing, or returning, drill segments, or rods, to a sloop or body truck parked behind the drill rig using a main haul hoisting winch 101 (shown in FIG. 1). The main haul winch hauls the drill rods out of the hole, typically in drill pipe segments. The capacity of the main haul winch often defines the maximum drill depth.

In design life calculation, for a rig similar to that shown in FIG. 1, it is anticipated that the winch rope movement for a 10-year life is around 8,300,000 metres. The high cycle rate and meterage results from rod tripping, for example, to change worn diamond impregnated bits or for drill hole alignment steering methods. Bit life varies due to geology and rock type. In addition, rod size can change at different depths.

Drill rods, used in deep diamond core drilling, are provided in 3 metre lengths, which are screwed together to make 6 metre or 9 metre length segments. The maximum segment length that can extracted using the main haul winch 101 (shown FIG. 1) is typically 6 or 9 metres (2 or 3 times 3 metre drill rods attached together). In Australia, normal practice for larger drills is to add rods in 6 metre lengths.

In light of the above, drill rods are transported to site in 6 metre lengths on a rod truck or sloop. In some instances, for example in the case of smaller drills, drill rods are left in 3 metre lengths. In Australia, the majority of drilling machines in operation add in 3 or 6 metre lengths, and pull in 6 or 9 metre lengths.

As the drill hole becomes deeper, and the drill bit needs to be replaced, there is a need to rack the 6 or 9 metre rod segments on top of the stored 6 metre rod segments. Drill rods vary in outside diameter depending on the depth or drilling program.

The main function of deep diamond core drilling, also referred to as continuous coring, is the retrieval of a core sample. A wireline winch fitted with a rope length to match its drill depth is attached to a latching mechanism called an overshot. This is used during the retrieval of the core sample. The drill string is clamped at the mast base with the pipe in an open configuration. The drill rotation head, which connects and rotates the rods, travels to the mast top and is racked away or to the side. The overshot is lowered down the open pipe until it latches with the inner tube head assembly down below. Depending on the hole depth this may take some time.

The inner tube contains the rock core sample. If intact, the rock core sample may be in the form of a cylindrical rod which needs to be handled after it exits the drill string. Relatively recently, rod pushers (shown in FIG. 2) have been added to the mast to assist with either the movement of the inner tube assembly towards a rear positioned slide, or the drill rods to or from the sloop. Rod pushers assist with rod handling. However, rod pushers may present other issues, including uneven rope spooling back to the winch drum.

In light of the above, the present invention aims to overcome at least one or more issues described above or provide a useful alternative to known commercial products already available.

Any references to methods, apparatus or documents of the prior art are not to be taken as constituting any evidence or admission that they formed, or form part of the common general knowledge.

SUMMARY OF INVENTION

In an aspect, the invention provides a rod handling apparatus for a drill rig including a drill rig mast and a hoisting winch, the rod handling apparatus including:

- a base assembly;
- a frame assembly coupled to the base assembly, the frame assembly including a pair of rails along which a conveyor assembly is adapted to travel along; and,
- the conveyor assembly adapted to be coupled to the hoisting winch for conveying a drill rod up and/or down the drill rig mast such that the drill rod is attachable to and/or detachable from a drill string.

In preferred embodiments, the rod handling apparatus is fully automatic and requires little to no manual handling of the drill rod. Advantageously, injuries relating to manual handling of drill rods during assembly of a drill string and/or pulling of drill rods are minimised.

The rod handling apparatus may be configurable into at least a non-use configuration and an in-use configuration. When in the in-use configuration, the conveyor assembly may be configured to be substantially elongate. When in the non-use configuration, the conveyor assembly may be configured to be substantially U-shaped.

In most embodiments, the conveyor assembly includes a linkage assembly and a drive assembly. Typically, the linkage assembly may be driven by the drive assembly.

The linkage assembly may include one or more sub-assemblies. In most embodiments, the linkage assembly includes five sub-assemblies, in the form of: a first sub-assembly, a second sub-assembly, a third sub-assembly, a fourth sub-assembly and a fifth sub-assembly. Typically, the sub-assemblies are connected in series to form the linkage assembly. In most embodiments, one or more of the sub-assemblies may be adapted to pivot relative to one another. In most embodiments, one or more of the sub-assemblies may be adapted to pivot in a vertical direction relative to one another.

The linkage assembly may be adapted to house one or more hydraulic lines.

Turning to the first sub-assembly, the first sub-assembly may be substantially elongate. The first sub-assembly may include a first end for mounting to a drill rod and a second end for pivotally mounting to the second sub-assembly. The first sub-assembly may include: a primary body, in the form of a first link member; and, a second arm extending from the primary body. The primary body may be in the form of an elongate cranked beam defining a first end for mounting the secondary arm and a second end for mounting to the second sub-assembly. The secondary arm may be in the form of an elongate arm defining a first end for pivotally mounting a hoist assembly and a second end for pivotally mounting to the primary body.

The first sub-assembly may further include the hoist assembly and a frame assembly for mounting the hoist assembly to the secondary arm. Advantageously, at least a portion of the frame assembly may be tilted to match or substantially match an angle of a drill string and/or drill rig mast. The frame assembly may include: a primary frame body for pivotally mounting relative to the secondary arm, and a float body for floating or moving relative to the primary frame body. The primary frame body may be pivoted or tilted away from the secondary arm. The primary frame may be tilted from 0 through to 90 degrees. In a non-tilted position, the primary frame body may rest parallel, or substantially parallel, to the secondary arm. In most embodiments, the float body is adapted to be lowered or raised through a spinner located on or toward a base the drill rig mast. Advantageously, a plug is able to be lowered or raised through the spinner in order to pull rods. The float body may include one or more stop members for limiting movement relative to the primary frame body.

In most embodiments, the frame assembly may further include a hydraulic member; and/or, chain member for moving the float body relative to the primary frame body. In most embodiments, the hydraulic member may be in the form of a hydraulic cylinder and/or the chain member may be in the form of an anti-back bend chain. Alternatively, the frame assembly may use gravity and/or the hoisting winch for moving the float body relative to the primary frame body.

The hoist assembly may include the plug for securing to the end of a drill rod or drill string; and/or, a drive motor for rotating the plug. The drive motor and/or the plug may be mountable to the frame assembly. Typically, the drive motor and/or plug is mounted to the float body of the frame assembly. The drive motor may include a clutch.

The plug may include an elongate body defining a first end and a second end. The plug may define a hoist assembly centreline. In most embodiments, the plug is mounted to the float portion of the frame assembly along a mid-portion of the elongate body, between the first and the second ends of the plug. Typically, the first end of the plug may include an opening, in the form of a bail, for mounting the plug to an end of a hoisting winch. The second end of the plug may include a threaded outer surface for mounting to an end of a drill rod or the drill string.

In most embodiments, the first sub-assembly may further include one or more tilt assemblies. Typically, the first sub-assembly includes: a first tilt assembly for tilting the primary body; a second tilt assembly for tilting the secondary arm; and/or, a third tilt assembly for tilting the frame of the hoist assembly. Each tilt assembly may include a hydraulic member. Each hydraulic member may be in the form of a hydraulic cylinder. Each tilt assembly may be adapted to tilt in a single plane.

The second sub-assembly may include an elongate body, in the form of a second link member. The elongate body including a first end for mounting to the first sub-assembly and a second end for mounting to the third sub-assembly. Alternatively, the second end may be for mounting to the fourth sub-assembly (when the third sub-assembly is not in use).

The second sub-assembly may include at least one: guide roller assembly, roller clamp assembly, and/or a jaw assembly. In some embodiments, the second sub-assembly may include at least a pair of guide roller assemblies. In some embodiments, each guide roller assembly is located towards an end of the elongate body. In some embodiments, the jaw clamp assembly and the roller clamp assembly are located towards opposite ends of the elongate body. In most embodiments, the jaw assembly is located towards the first end of the elongate body and the roller clamp assembly is located towards the second end of the elongate body.

The third sub-assembly may include an elongate body, in the form of a third link member. The elongate body including a first end for mounting to the second sub-assembly and a second end for mounting to the fourth sub-assembly. The third sub-assembly may include a guide roller assembly. In most embodiments, the guide roller assembly is located towards the second end.

The fourth sub-assembly may include a body comprising a first end for mounting to the third sub-assembly, or second sub-assembly when the third sub-assembly is not in use, and a second end for mounting to the fifth sub-assembly. The fourth sub-assembly may be adapted to be configurable into at least two configurations. The at least two configurable configurations may include an elongate configuration and/or a U-shaped configuration.

The body of the fourth sub-assembly may include multiple body portions. The multiple body positions may include: a first portion, in the form of a fourth link member; a second portion, in the form of a fifth link member; and, a third portion, in the form of a sixth link member. The first, second and third portions may be secured together in series to form the body of the fourth sub-assembly. The first, second and third portions may be secured together using one or more bolts. The second portion and the third portion may be adapted to pivot in a horizontal direction relative to the first portion. The second portion and the third portion may also be adapted to prevent pivoting in the vertical direction such that the first, second and third portions together form a ridge body.

The fourth sub-assembly may further include one or more lock bolts. The lock bolts may be removable lock bolts. In most embodiments, the lock bolts may have an engaged configuration and a non-engaged configuration. When the lock bolts are in the engaged configuration, the first, second and third portions are prevented from pivoting relative to one another. When the lock bolts are in the non-engaged configuration, the second and third portions are allowed to pivoting relative to the first portion. Advantageously, when not in use, the conveyor assembly may be folded into a shorter configuration, for example, in anticipation of transportation.

The fourth sub-assembly may further include: a clamp roller assembly; and/or, a guide roller assembly. Typically, the clamp roller assembly and/or the guide roller assembly may each be located on the third portion. In some embodiments, the clamp roller assembly and/or the guide roller assembly may each be located towards the same end of the fourth sub-assembly. In most embodiments, the clamp roller assembly and/or the guide roller assembly may each be located towards the second end of the fourth sub-assembly.

The fifth sub-assembly may include a first end for mounting to the fourth sub-assembly and a second end for mounting to a drive assembly. The fifth sub-assembly may include a first body, in the form of a seventh link member, and a second body. The first body may be in the form of an outer or primary body and the second body may be in the form of an inner or secondary body. The first body may be in the form of an elongate tube defining an elongate channel for receiving at least a portion of the second body. The first body may include a capped end for preventing the inner body from extending all the way through the outer body. The second body may be in the form of a corresponding elongate body. The second body may include one or more stop formations to prevent the inner body from extending all the way out of the outer body. The second body may include one or more rib formations for guiding movement of the second body relative to the first body.

The fifth sub-assembly may further include a hydraulic member for extending the secondary arm relative to the primary arm. The hydraulic member may be in the form of a hydraulic cylinder. Advantageously, in preferred embodiments, the fifth link assembly may act to fine position the hoist drive centreline with a mast drill string centreline defined by the drilling rig. The fifth sub-assembly may also provide an allowance for different site set up positions of the rig relative to the loader.

As mentioned above, the conveyor assembly may further include a drive assembly for driving the linkage assembly. The drive assembly may further include an attachment formation for attaching the drive assembly to the fifth sub-assembly. The attachment formation may be in the form of a pin for being received within a corresponding attachment formation of the fifth sub-assembly.

The drive assembly may further include at least one hydraulic member. In some embodiments, the drive assembly includes at least two hydraulic members for side to side adjustment of the drill rod or plug. Each hydraulic member may be in the form of a hydraulic cylinder. The drive assembly may include an encoder.

The drive assembly may be in the form of a drive trolley. The drive assembly may include a trolley frame for mounting components of the drive assembly; a drive motor for driving the linkage assembly; drive rollers; idler rollers; track rollers; and/or, a brake for decreasing the speed of, or locking in position, the drive assembly.

Alternatively, the drive assembly may be in the form of a guide trolley and winch assembly for winching the guide trolley along the pair of rails. The guide trolley may include a guide trolley frame for mounting one or more components of the guide trolley. The one or more components of the guide trolley may include idler rollers, track rollers, wear strips and/or one or more attachment formations for attaching the winch assembly. The guide trolley frame may further include one or more attachment formations for attaching one or more cables of the winch assembly to the guide trolley. The winch assembly may include a winch. The winch may include a motor drive, in the form of a hydraulic motor drive. The winch may be a two-sided winch. The winch assembly may further include a pair of pulleys, and a pair of cables connected to a drum. Each pulley may be in the form of an idler sheave. The winch assembly may be mounted to the frame assembly of the handling apparatus. Advantageously, the guide trolley may be pushed or pulled along the pair of rails using the winch assembly. The winch assembly may include the encoder of the drive assembly.

As mentioned above, the conveyor assembly includes: one or more guide roller assemblies adapted to travel along the pair of rails, one or more roller clamp assemblies adapted to clamp a portion of a drill rod, a jaw assembly adapted to hold a portion of a drill rod, and/or one or more stop assemblies adapted to prevent vertical pivoting between adjacent sub-assemblies.

In most embodiments, each guide roller assembly includes: a pair of arms for mounting a pair of guide rollers; the pair of guide rollers for travel along the pair of rails of the frame; and/or, a pair of shock absorbers for absorbing movement of the respective sub-assembly. Each shock absorber may be in the form of a spring. As mentioned above, at least the second, third and fourth sub-assemblies each include at least one guide roller assembly.

In most embodiments, each roller clamp assembly includes: a pair of rollers for hugging or clamping a drill rod; and/or, a pair of hydraulic members for activating or deactivating the pair of rollers. Each of the hydraulic members may be in the form of a hydraulic cylinder. The pair of rollers may be interconnected with gear teeth and rotated using a single cylinder. Advantageously, the roller clamp assembly holds the drill rod centrally but allows the rod to move axially. As mentioned above, at least the second sub-assembly and the fourth sub-assembly each include at least one roller clamp assembly.

In most embodiments, the jaw assembly includes at least one frame for housing the at least one chain. In some embodiments, the jaw assembly may include at least one upper clamp frame and at least one side clamp frame. In most embodiments, the jaw assembly may include at least one upper clamp frame and a pair of side clamp frames. The upper clamp frame may be adjustable. Further, each side clamp frame may be in the form of a plate. Each jaw assembly may further include at least one chain. In some embodiments, the jaw assembly may further include at least one upper chain and at least one side chain. In most embodiments, the jaw assembly further include at least one upper chain and at least two side chains. In most embodiments, the upper chain may be spring loaded. Each jaw assembly may further include a pair of hydraulic members for operating the side jaw frames. Each hydraulic member may be in the form of a hydraulic cylinder. As mentioned above, at least the second sub-assembly includes a jaw assembly.

In most embodiments, each stop assembly includes: a stop member; an elongate arm for abutting the stop member when in an activated condition; and/or, a hydraulic member for moving the elongate arm from a first portion to a second position, wherein the first position is an activated condition which prevents vertical pivoting between adjacent sub-assemblies, and the second position is a deactivated position that allows vertical pivoting between adjacent sub-assemblies. The hydraulic member may be in the form of a hydraulic cylinder. Typically, the hydraulic member and the elongate arm are mounted to one sub-assembly and the stop member is mounted to an adjacent sub-assembly. Each stop assembly may prevent vertical pivoting between a pair of adjacent sub-assemblies. Usually, the conveyor assembly includes at least two stop assemblies, in the form of a first stop assembly located between the second and third sub-assemblies, and a second stop assembly located between the third and fourth sub-assemblies.

The rod handling apparatus may further include an inner tube handling assembly. Typically, the inner tube handling assembly may be mounted to the frame of the rod handling apparatus such that manoeuvring of the frame, in turn, manoeuvres the inner tube assembly. In most embodiments, the inner tube handling assembly may be mounted above, or substantially above, the frame of the rod handling apparatus.

The inner tube handling assembly may include: a primary tray; a secondary tray; and/or, an extension arm for mounting the secondary tray to the primary tray. The primary tray may be raised and lowered relative to the frame of the rod handling apparatus, and extended towards and away from the drill rig mast, using one or more arms. The arms may be in the form of pivot arms. The primary tray may include a first end for mounting the secondary tray and a second end. The second end of the primary tray may include a roller. The primary tray may further include a side wall. The side wall of the primary tray may be adapted to be raised and/or lowered.

The secondary tray may include a first free end and a second end for mounting to the extension arm. The free end of the secondary tray may include a roller. The secondary tray may be pivoted relative to the primary tray such that the inclination of the secondary tray relative to the primary tray matches, or substantially matches, the inclination of the drill rig mast.

The extension arm may be adapted to extend between the primary tray and the secondary tray. The extension arm may include a first end for mounting to the secondary arm and a second end for mounting to the primary arm. The extension arm may be adapted to vary the distance between the primary tray and the secondary tray. The extension arm may be adapted to extend the secondary tray away from the primary tray and/or towards the drill rig mast.

The inner tube handling assembly may include one or more hydraulic members. In most embodiments, the inner tube handling assembly includes: a primary tray hydraulic member for pivoting the primary tray; an extension arm hydraulic member for extending or retracting the extension arm; a secondary tray hydraulic member for tilting the secondary tray; and/or, a side wall hydraulic member for raise or lowering the side wall of the primary tray. Each hydraulic member may be in the form of a hydraulic cylinder.

As mentioned above, the rod handling apparatus may be configurable into at least a non-use configuration and an in-use configuration. When in the non-use configuration, the hydraulic members of the inner tube handling assembly may all be retracted such that: the primary tray is located below the pair of rails; the secondary tray is positioned perpendicular to the primary tray; the extension arm is fully retracted such that the secondary and the primary tray are positioned adjacent to one another; and/or, the side wall is in a closed position.

The rod handling apparatus may further include a presenter assembly for presenting the drill rod, or a rod segment including the drill rod, to the conveyor assembly. The presenter assembly may be mounted to the frame of the rod handling apparatus such that manoeuvring of the frame, in turn, manoeuvres the presenter assembly. Typically, the presenter assembly is positioned under, or substantially under, the conveyor assembly.

The presenter assembly may include at least one arm assembly for manoeuvring the drill rod or rod segment. In most embodiments, the presenter assembly may include a pair of arm assemblies, in the form of a first arm assembly for manoeuvring the drill rod, or rod segment, from a sloop or truck to the rod handling apparatus; and, a second arm assembly for manoeuvring the drill rod, or rod segment, from the first arm assembly toward the conveyor assembly. Each arm assembly may include an arm and a U-shaped hand for cupping the drill rod or rod segment. The U-shaped hand of the second arm assembly may include a fixed member and a pivotable member for pivoting relative to the fixed portion. Both arm assemblies may be adapted to be raised and/or lowered relative to the pair of rails.

The rod handling apparatus may further include a rail assembly. The rail assembly may include the pair of rails. The pair of rails may be in the form of a pair of elongate rails. Typically, the elongate pair of rails will be parallel or substantially parallel. The pair of rails may be any size or shape. In most embodiments, the pair of rails will extend be at least the length of the total length of the conveyor assembly, or longer.

The rail assembly may include a first portion and a second portion. The first portion may be fixed to the frame of the rod handling apparatus such that manoeuvring of the frame, in turn, manoeuvres the frame assembly. Each portion of the frame assembly may be substantially elongate and define a first end and a second end. The second end of the first portion may abut the first end of the second portion. The second portion may be adapted to pivot relative to the first portion. The rail assembly may include a hinge member for pivoting the second portion relative to the first portion such that the first portion and the second portion form a U-shape. The rail assembly may include at least one securing mechanism for securing the second portion relative to the first portion.

As mentioned above, the rod handling apparatus may be configurable into at least a non-use configuration and an in-use configuration. When in the in-use configuration, the rail assembly may be configured to be substantially elongate. When in the non-use configuration, the rail assembly may be configured to be substantially U-shaped. When in the in-use configuration, the rail assembly may be configured such that the first portion and the second portion are located in series relative to one another. When in the non-use configuration, the rail assembly may be configured such that the first portion and the second portion are located parallel, or substantially parallel, to one another.

As mentioned above, the rod handling apparatus includes a frame assembly including a frame, and a base assembly for mounting the frame assembly, the base assembly, including a base. The base may be any size or shape suitable for mounting the frame. The base assembly may include legs. In some embodiments, the base assembly includes four legs. In most embodiments, the base assembly include six legs. The legs may be in the form of height adjustable legs. The legs may be in the form of jack legs. The base assembly may further include a pair of frame rails along which the frame assembly is movable. The frame assembly may be any suitable size or shape for mounting the inner tube assembly, presenter assembly, conveyor assembly, and/or rail assembly.

The rod handling apparatus may be configurable in at least two configurations. The at least two configurations may be an operative or in-use configuration and a non-operative or non-use configuration. When in the operative configuration, the conveyor assembly is configured in an elongate configuration. When in a non-operative configuration, the conveyor assembly is configured in a folded or U-shaped configuration.

In most embodiments, the conveyor assembly is hauled by a winch cable, up and down a drill rig mast, both of which form part of the drilling rig.

The conveyor assembly may be in the form of a rod handling assembly.

In most embodiments, the conveyor assembly may be adapted to secure the drill rod, or rod segment, thereto. In most embodiments, the conveyor assembly may be adapted to hold and/or grip the drill rod, or rod segment. Typically, at least a portion of the conveyor assembly may be adapted to pivot away from away from the pair of rails of the frame. Typically, at least a portion of the conveyor assembly may be adapted to maintain engagement with the pair of rails during hauling of a drill rod, or rod segment.

According to another aspect of the present invention, there is provided a method for conveying a drill rod to and/or from a drill rig, the drill rig including a drill rod mast, hoisting winch and a drill rotation head and/or spinner, the method including:

- coupling the drill rod to a conveyor assembly using one or more clamp assemblies;
- coupling the conveyor assembly to the hoisting winch;
- conveying the conveyor assembly up the drill rig mast using the hoisting winch;
- aligning the drill rod relative to a drill string using the conveyor assembly; and,
- attaching an end of the drill rod to an end of a drill string using the drill rotation head and/or a spinner.

According to another aspect of the present invention, there is provided a method for conveying a drill rod to and/or from a drill rig, the drill rig including a drill rod mast, hoisting winch and a spinner, the method including:

- aligning a conveyor assembly relative to an end of a drill string or drill rod such that a hoist assembly centreline of the conveyor assembly is coaxial with a centreline defined by the drill string or drill rod;
- coupling the drill string or drill rod to the hoist assembly of the conveyor assembly;
- conveying the conveyor assembly and drill string or drill rod up the drill rig mast using the hoisting winch;
- separating or attaching a portion of the drill string or drill rod to or from the drill string using the spinner;
- clamping or unclamping an end of the drill string.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 6*a* shows an enlarged view of the first end of the first sub-assembly shown in FIG. 6.

FIG. 7 shows a second sub-assembly which forms part of the conveyor assembly shown in FIG. 5.

FIG. 8 shows a third sub-assembly which forms part of the conveyor assembly shown in FIG. 5.

FIG. 9 shows a fourth sub-assembly which forms part of the conveyor assembly shown in FIG. 5.

DETAILED DESCRIPTION OF PREFERRED EMBODIMENTS

Figure 1:
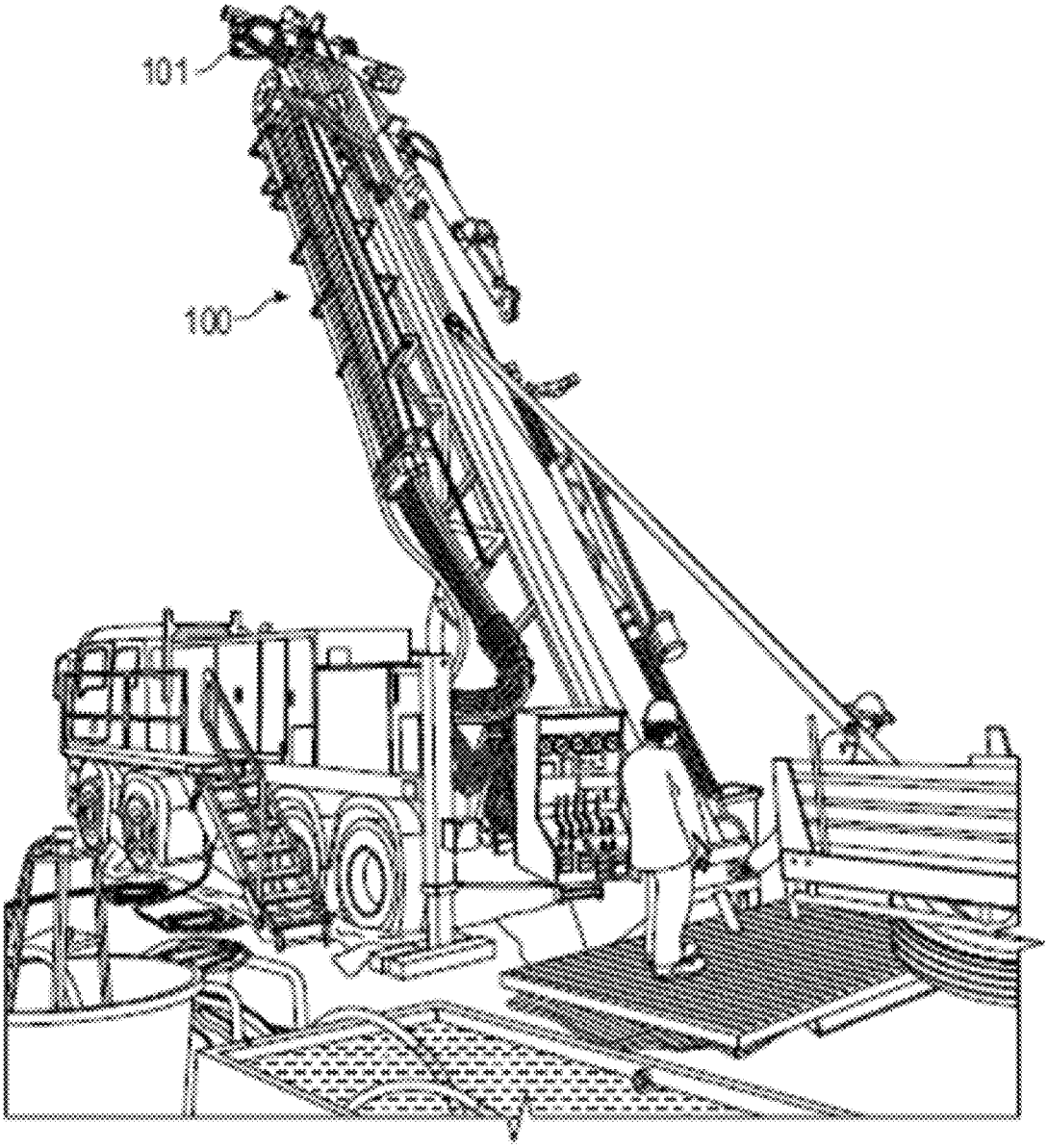
Figure 1 (prior art)
FIG. 1 shows a known multi-purpose drill rig using a main haul hoisting winch to haul drill rods or rod segments to or from a sloop (or body truck) parked behind the drill rig.
Figure 2:
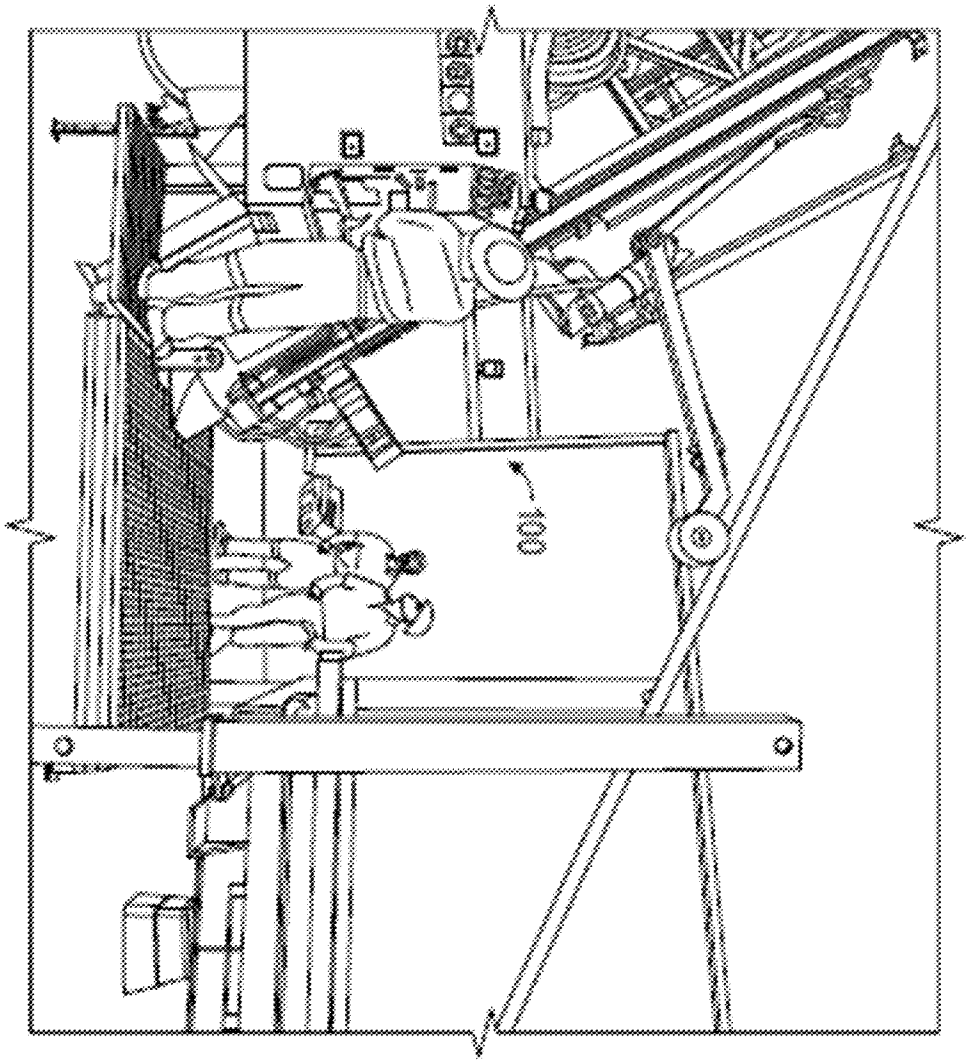
Figure 2 (prior art)
FIG. 2 shows a known drill rod pusher guiding a drill rod from a mast to a sloop.
Figure 3:
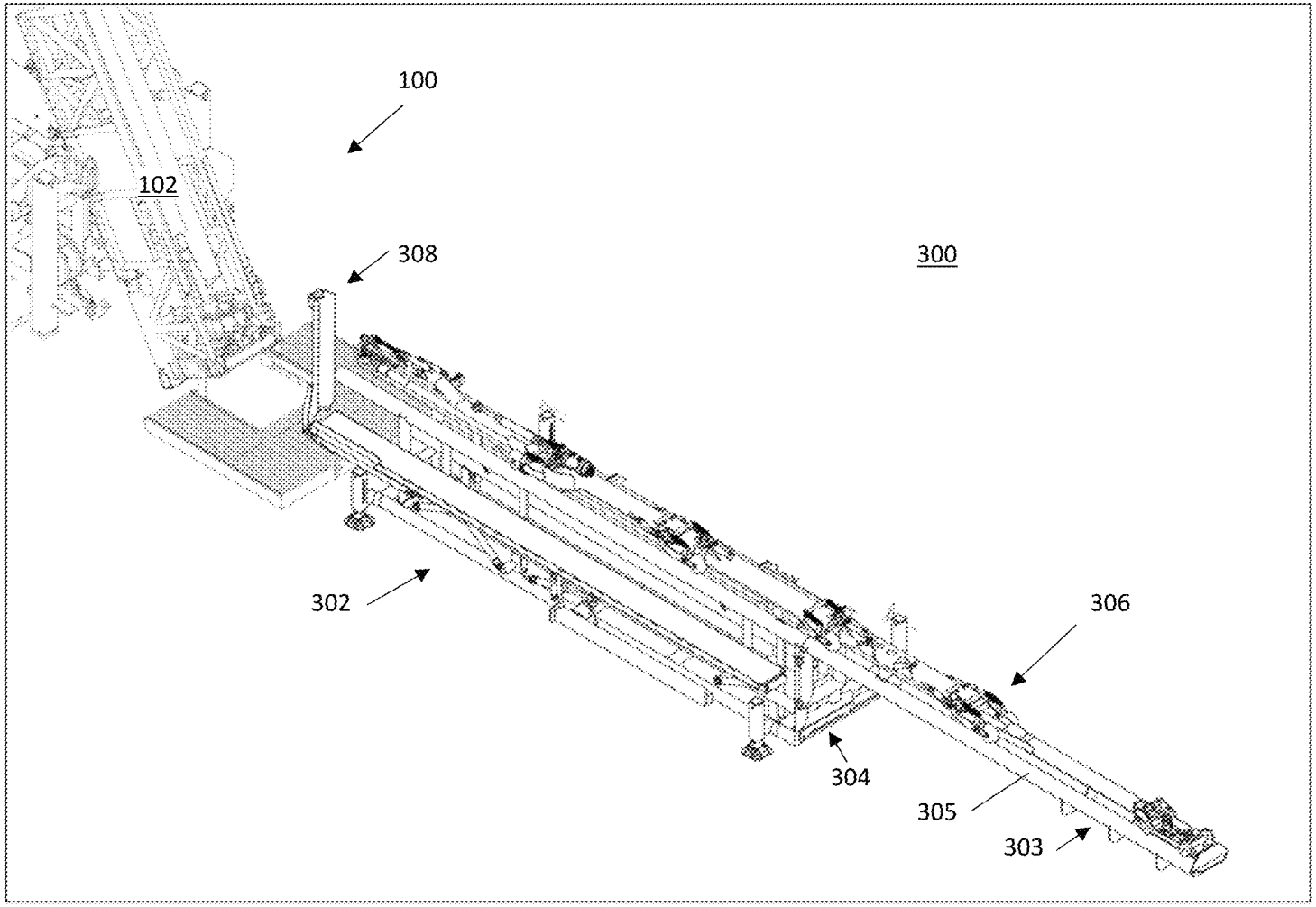
FIG. 3 shows a rod handling system, located adjacent a drill rig, in accordance with a preferred embodiment of the present invention.

FIG. 3 shows a rod handling apparatus 300 for a drill rig 100 in accordance with a preferred embodiment of the present invention. Rod handling apparatus 300 includes a base 302; a frame 304 mounted to the base, the frame including a pair of rails 305; and, a conveyor assembly 306 for loading a drill rod 102; wherein the conveyor assembly 306 is adapted to travel along the pair of rails.

In the preferred embodiments, the rod handling apparatus is fully-automatic and requires little to no manual handling of the drill rod, or rod segment that includes the drill rod. Advantageously, injuries relating to manual handling of drill rods during assembly of a drill string and/or pulling of drill rods is minimised.

As best shown in FIG. 3, the preferred embodiment of the rod handling apparatus 300 includes: base assembly 302 for mounting a frame assembly 304, the base assembly including a base; the frame assembly 304 for mounting a rail assembly 303, the frame assembly including the frame; rail assembly 303 for mounting a conveyor assembly 306; the conveyor assembly 306 adapted travel along the pair of rails 305; a presenter assembly 1300 for presenting the drill rod, or rod segment, to the conveyor assembly; and, an inner core handling assembly 308 for handling an inner core sample. Rail assembly, presenter assembly and the inner tube handling assembly 303, 1300, 308 are mounted to frame assembly 304 such that manoeuvring of the frame assembly relative to base assembly 302 concurrently manoeuvres the rail assembly, presenter assembly and the inner tube handling assembly. Further, conveyor assembly 306 is mounted to rail assembly 303 such that the conveyor assembly is adapted to travel along rails 305.

Figure 5:
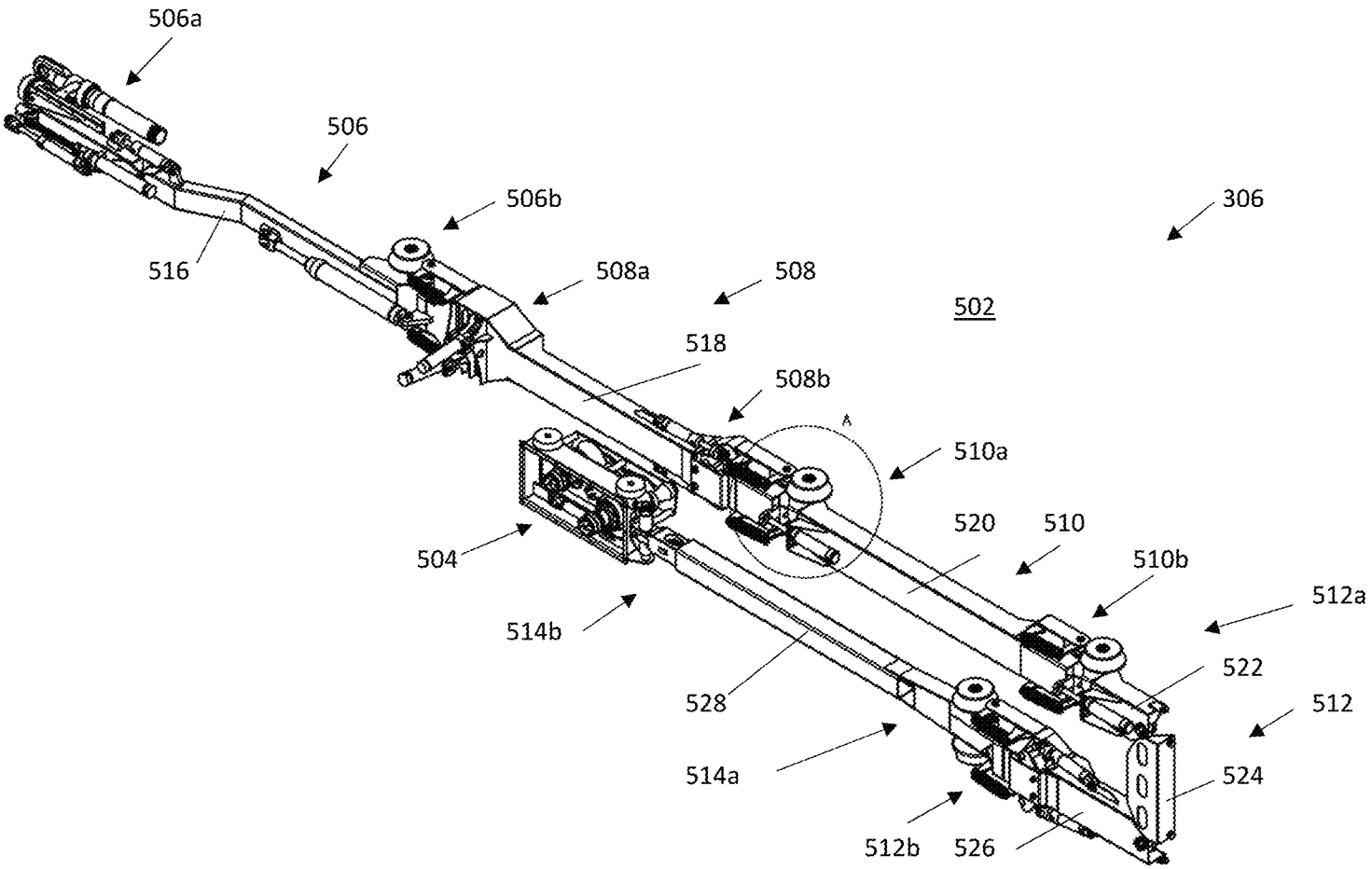
FIG. 5 shows a conveyor assembly as shown in FIG. 4, in the non-use configuration, and an enlarged section A showing a back bend stop assembly in an activated configuration.

Turning to conveyor assembly 306, assembly 306 includes: a linkage assembly 502 including first, second, third, fourth and fifth sub-assemblies 506, 508, 510, 512 and 514; and, drive assembly, in the form of drive trolley 504. As best shown in FIG. 5, sub-assemblies 506, 508, 510, 512, 514, 516 and drive assembly are connected in series to form linkage assembly 502, and are adapted to pivot relative to one another in the vertical direction.

Figure 6:
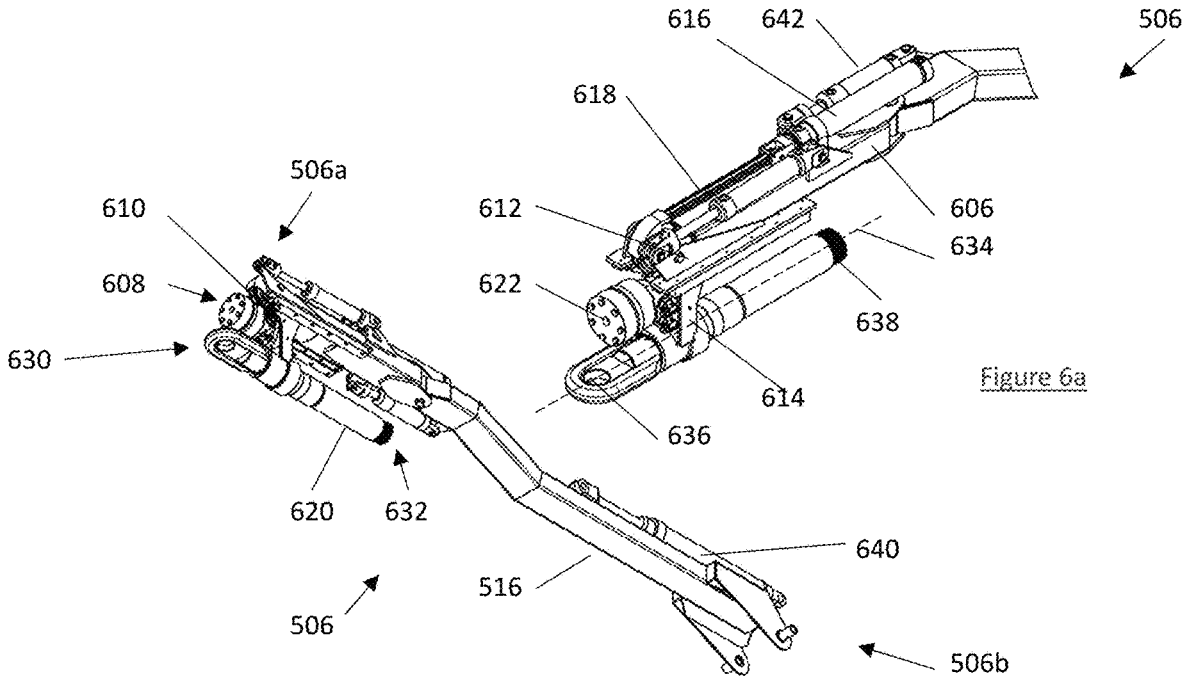
FIG. 6 shows a first sub-assembly which forms part of the conveyor assembly shown in FIG. 5.

Turning to FIG. 6, first sub-assembly 506 is substantially elongate, and includes a first end 506*a* for mounting to an end of a drill rod, or rod segment, and a second end 506*b* for pivotally mounting to second sub-assembly 508. First sub-assembly 506 includes: a primary body, in the form of a first link member 516; and, a second arm 606 extending from, and pivotally mounted, to an end of the primary body. In the preferred embodiment shown, first link member 516 is in the form of an elongate cranked beam. First sub-assembly 506 further includes hoist assembly 608 and frame assembly 610 for mounting the hoist assembly to second arm 606. Frame assembly 610 includes primary frame body 612 for pivotally mounting relative to the secondary arm, and float body 614 for moving relative to the primary frame body. In the preferred embodiment shown, primary frame body 612 is tiltable away from secondary arm about a pivot located towards the first end of the sub-assembly 506. In the preferred embodiment shown, primary frame body 612 is tiltable from 0 through to 90 degrees. Advantageously, the primary frame body is tiltable to match, or substantially match, an angle of a drill string such that plug 620 is able be secured onto the end of the drill string. In a non-tilted position, the primary frame body 612 rests parallel, or substantially parallel, relative to secondary arm 606. In the preferred embodiment show, hoist assembly 608 is secured to float body 614 such that the hoist assembly moves with the float body. Float body 614 is adapted to be lowered or raised such that the plug 620 attached thereto is lowered or raised through a spinner located on or toward a base of the drill rig mast (see FIGS. 17 and 18). Advantageously, a plug 620 is able to be lowered or raised through the spinner such that the plug is mountable to the end of the drill string. Float body 614 includes stop members (not shown) for limiting movement relative to primary frame body 612. Frame assembly 610 further includes a hydraulic cylinder 616; and anti-back bend chain 618 for moving float portion 614 relative to primary frame body 612. Hoist assembly 608 includes plug 620 for securing to the end of a drill rod or drill string; and drive motor 622 for rotating the plug. As mentioned above, both drive motor 622 and plug 620 are mounted to float body 614. The drive motor includes a clutch (not shown). Plug 620 includes an elongate body defining a first end 630 and a second end 632. The plug also defines a hoist assembly centreline 634. In the preferred embodiment shown, plug 620 is mounted to the float portion along a mid-portion of the elongate body, between the first and the second ends 630, 632 of the plug. End 630 of plug 620 includes opening, in the form of a bail 636, for mounting the plug to an end of the drill rig (i.e. hoisting) winch (not shown). End 632 of the plug includes a threaded outer surface 638 for mounting to an end of drill string 202.

First sub-assembly 506 further includes a first tilt assembly, in the form of primary body tilt assembly, for tilting the primary body, the first tilt assembly includes a hydraulic cylinder 640; a second tilt assembly, in the form of second arm tilt assembly, for tilting the secondary arm, the second tilt assembly including another hydraulic cylinder 642; and, a third tilt assembly, in the form of a hoist assembly tilt assembly, for tilting the frame of the hoist assembly, the third tilt assembly including a further hydraulic cylinder 644. Each tilt assembly may be adapted to tilt in a single plane.

Figure 7A:
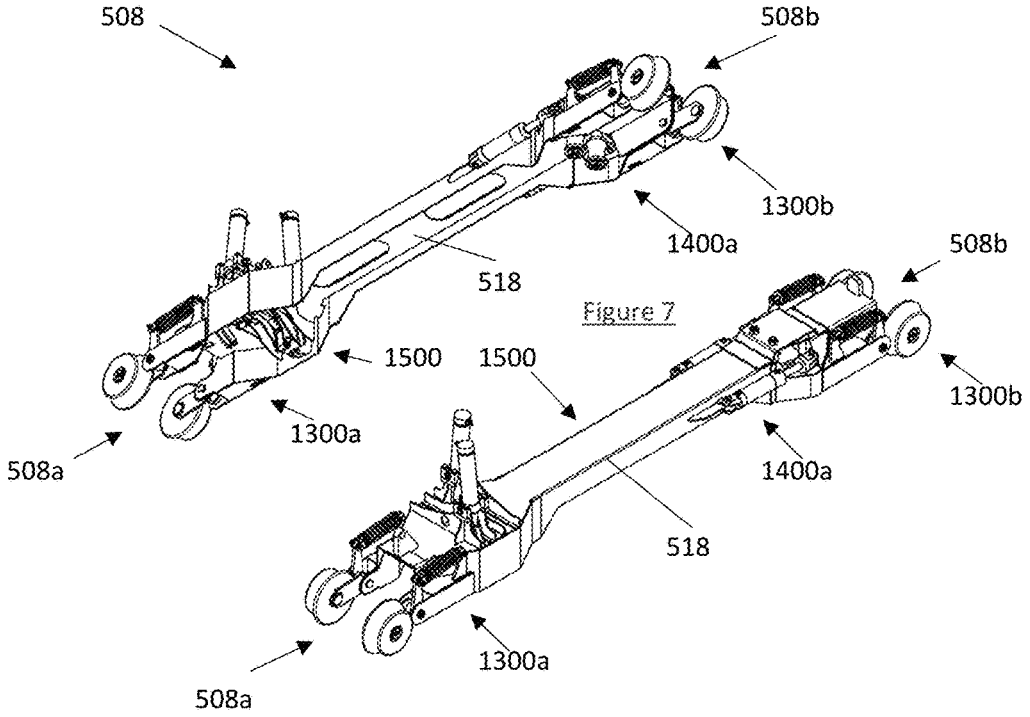
FIG. 7*a* shows an alternate view of the second sub-assembly shown in FIG. 7.

Turning to FIG. 7, second sub-assembly 508 includes an elongate body, in the form of a second link member 518. Link member 518 includes a first end 508*a* for mounting to first sub-assembly 506 and a second end 508*b* for mounting to third sub-assembly 510. In an alternative embodiment (not shown), second end 508*b* is mountable to fourth sub-assembly 512 (when the third sub-assembly is not in use).

Second sub-assembly 508 further includes a pair of guide roller assemblies 1300*a*, 1300*b*, a roller clamp assembly 1500*a* and jaw assembly 1400. Guide roller assemblies 1300*a* and 1300*b* are located towards opposite ends of link member 518. Further, roller clamp assembly 1500*a* is located towards end 508*b* and jaw assembly is located towards end 508*a* of link member 518.

Figure 8A:
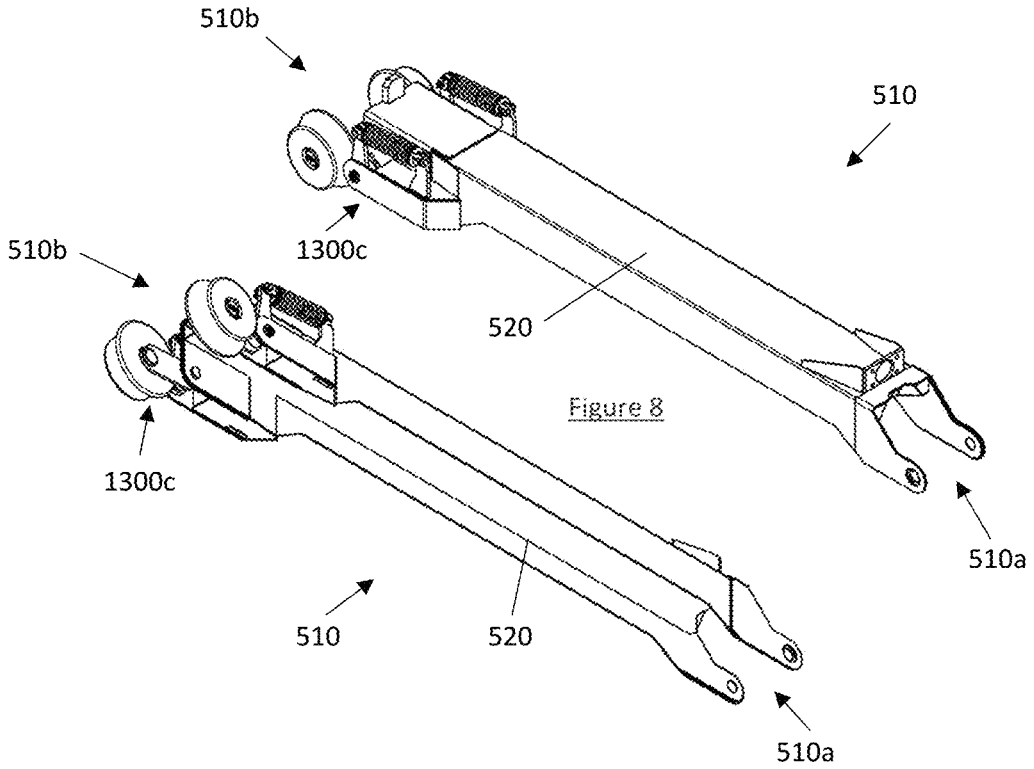
FIG. 8*a* shows an alternate view of the third sub-assembly shown in FIG. 8.

Turning to FIG. 8, third sub-assembly 510 includes an elongate body, in the form of a third link member 520. Third link member 520 includes first end 520*a* for mounting to the second sub-assembly and a second end 520*b* for mounting to the fourth sub-assembly 512. Third sub-assembly 510 includes guide roller assembly 1300*c* located at end 510*b*.

Figure 9A:
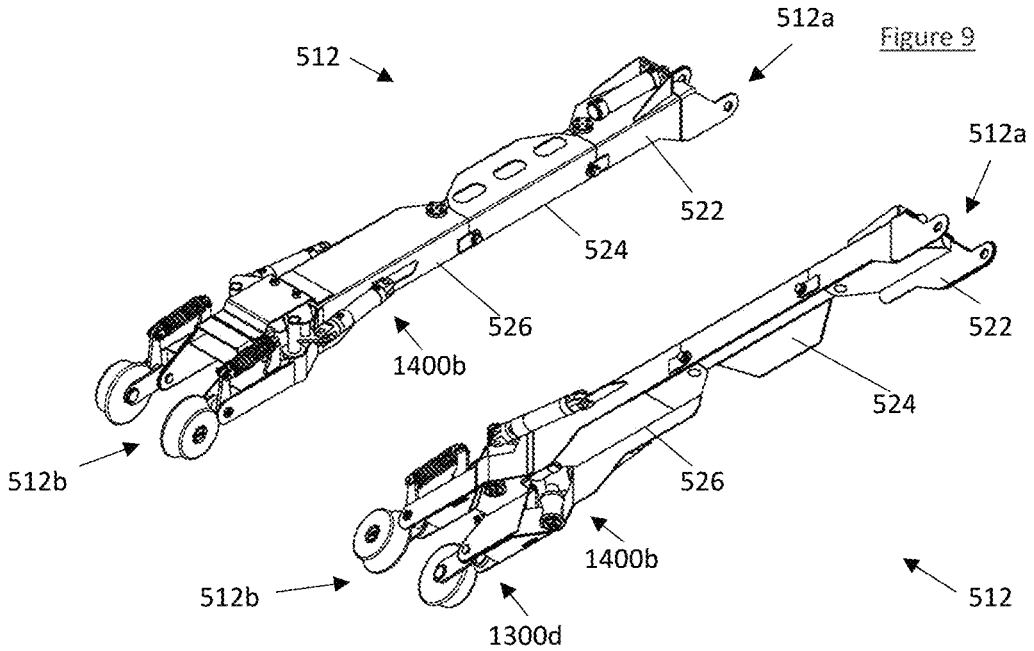
FIG. 9*a* shows an alternate view of the fourth sub-assembly shown in FIG. 9.

Turning to FIG. 9, fourth sub-assembly 512 includes a body 900 comprising a first end 512*a* for mounting to the third sub-assembly 510 and a second end 512*b* for mounting to the fifth sub-assembly 514. In an alternative embodiment, first end 512*a* is mountable to second sub-assembly 508 when the third sub-assembly is not in use. Body 900 includes a first portion, in the form of a fourth link member 522; a second portion, in the form of a fifth link member 624; and, a third portion, in the form of a sixth link member 526. Link members 522, 524 and 526 are secured together using bolts in series to form body 900 such that link members 524 and 526 are pivotable in a horizontal direction relative to link member 522.

Fourth sub-assembly 512 further includes removable lock bolts 906 for locking link members 522, 524 and 526 together. Lock bolts 906 are configurable in an engaged configuration and a non-engaged configuration. When lock bolts 906 are in the engaged configuration, the link members 522, 524 and 526 are prevented from pivoting relative to one another and form a rigid body. When the lock bolts are in the non-engaged configuration, links 524 and 526 are allowed to pivoting relative to link 522. Advantageously, when not in use, the conveyor assembly 300 is foldable into a U-shaped configuration (as shown in FIG. 5).

Fourth sub-assembly 512 further includes clamp roller assembly 1500*b* and guide roller assembly 1300*d*. In the preferred embodiment shown, roller clamp roller assembly 1500*b* and the guide roller assembly 1300*d* are positioned towards end 512*b* of link member 526.

Figure 10:
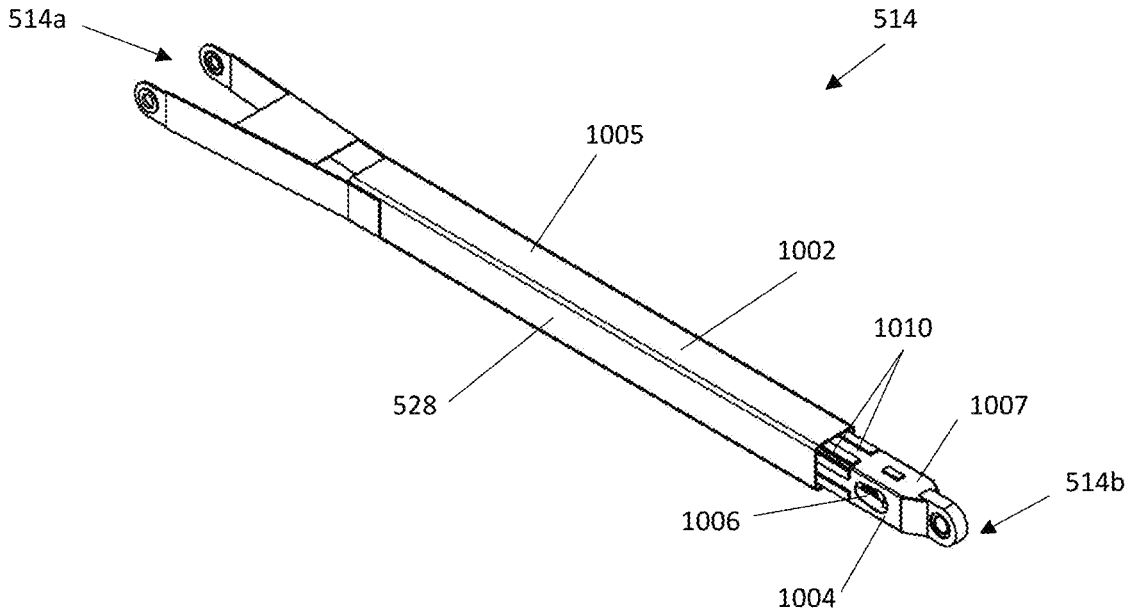
FIG. 10 shows a fifth sub-assembly which forms part of the conveyor assembly shown in FIG. 5.

Turning to FIG. 10, fifth sub-assembly 514 includes a first end 514*a* for mounting to fourth sub-assembly 512 and a second end 514*b* for mounting to the drive trolley 504. Fifth sub-assembly 514 includes an elongate body, in the form of a seventh link member 526. Link member 526 comprises an outer, elongate, tubular body 1005 and an inner elongate body 1007 for being received in body 1005. Outer body 1005 includes a capped end for preventing inner body 1007 from extending all the way through the outer body. Inner body 1007 includes a plurality of ribs 1010 for guiding movement of the body within outer body 1005. Inner body 1007 also includes stop formations (not shown) for preventing inner body 1007 from separating from outer body 1005. Sub-assembly includes hydraulic cylinder 1006 for positioning body 1005 relative to body 1007. In preferred embodiments, the fifth sub-assembly acts to fine position the hoist drive centreline with a mast drill string centreline defined by the drilling rig.

Figure 4:
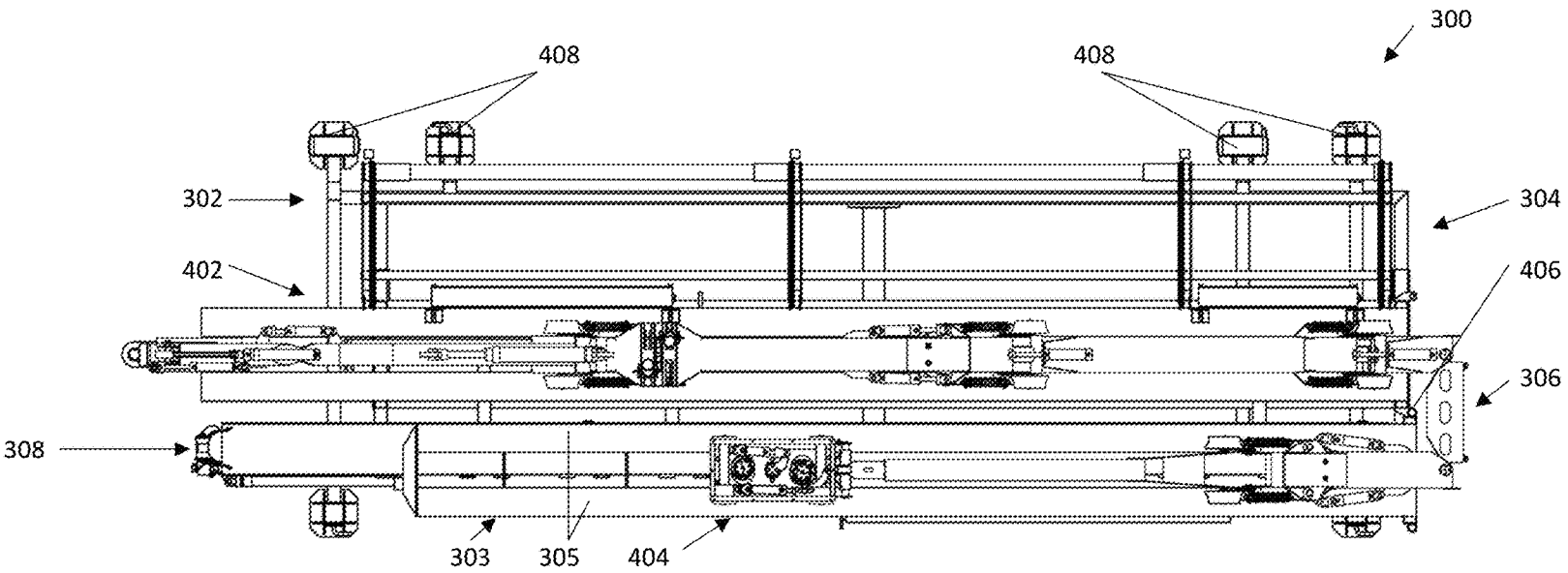
FIG. 4 shows a top view of the rod handling system shown in FIG. 3, in a non-use configuration.
Figure 11:
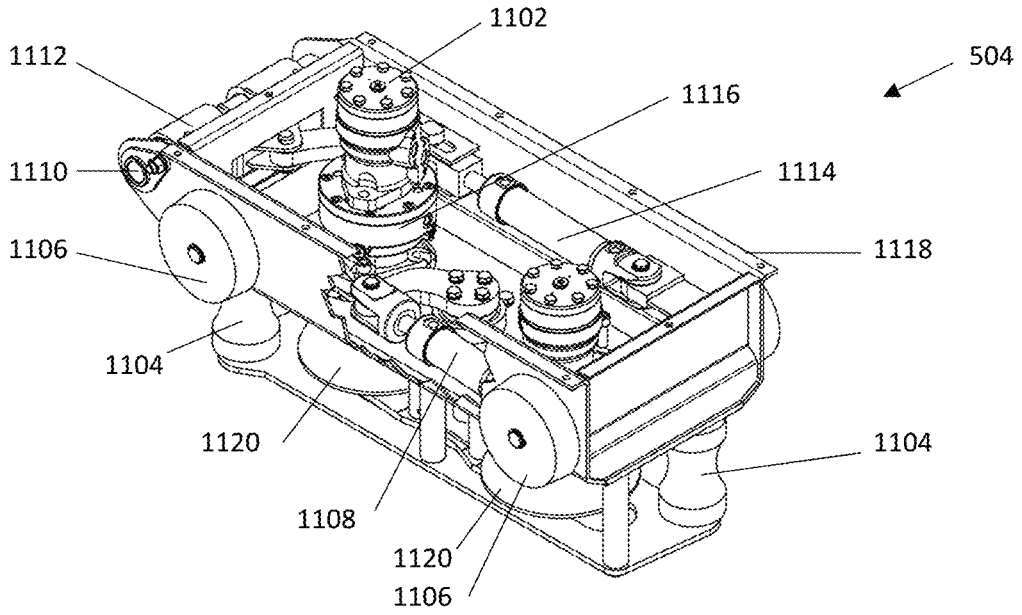
FIG. 11 shows a drive assembly which forms part of the conveyor assembly shown in FIG. 5.

As best shown in FIGS. 3 and 4, the conveyor assembly 300 further includes a drive assembly, in the form of a drive trolley 504, for driving linkage assembly 502. Turning to FIG. 11, drive trolley 504 includes: a trolley frame 1118 for mounting components of the drive trolley; a drive motor 1102 for driving linkage assembly 502; drive rollers 1120; idler rollers 1104; track rollers 1106; a brake 1116 for decreasing the speed of, or locking in position, the drive assembly; and, a side shift frame 1112. The drive assembly further includes a pull pin 1110 for mounting the drive assembly to fifth sub-assembly 514. The drive assembly further includes a drive roller load cylinder 1108 and a side shift cylinder 1114. Cylinders and are in the form of hydraulic cylinders.

Figure 29:
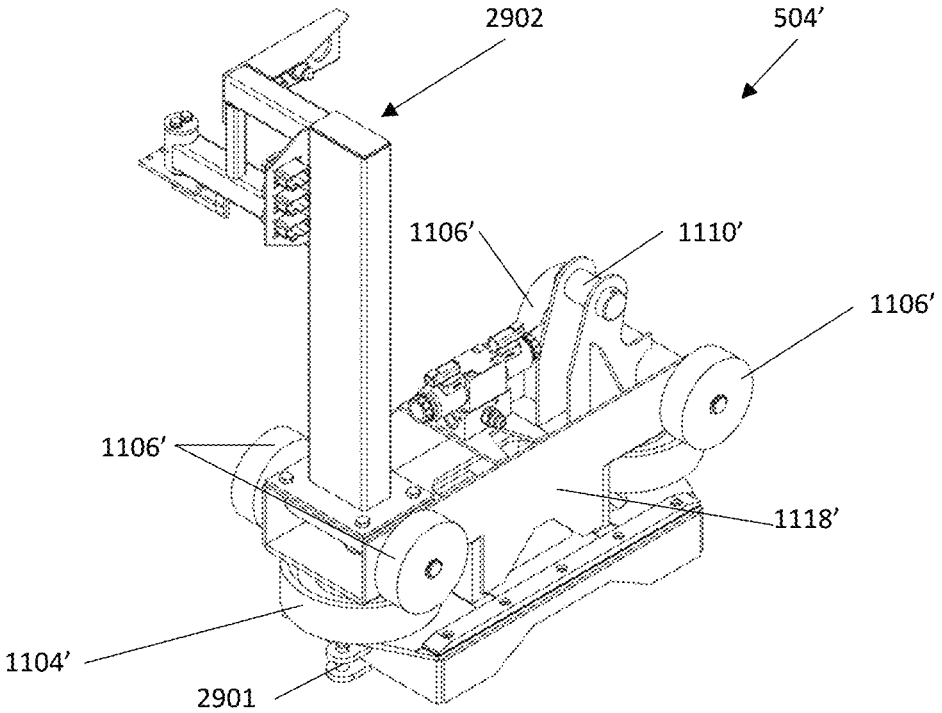
FIG. 29 shows a guide trolley in accordance with the second preferred embodiment of the present invention.
Figure 30:
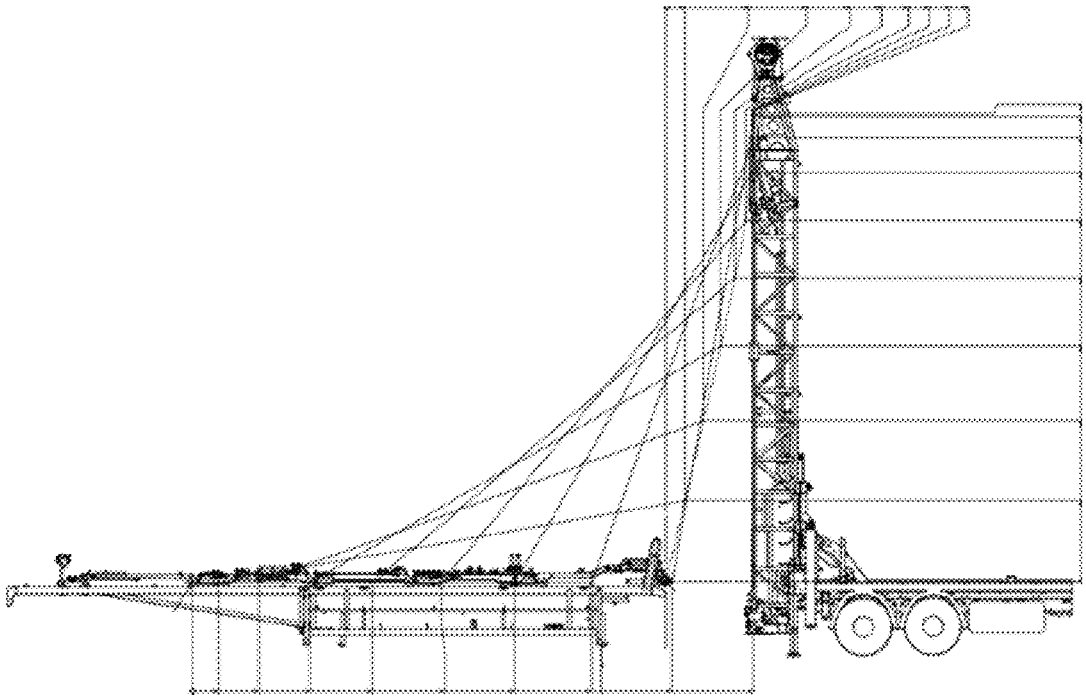
FIG. 30 shows a rod handling system in accordance with the second preferred embodiment of the present invention, located adjacent a drill rig including a drill mast extending at 90 degrees, the rod handling system loading a 9-meter drill rod.
Figure 31:
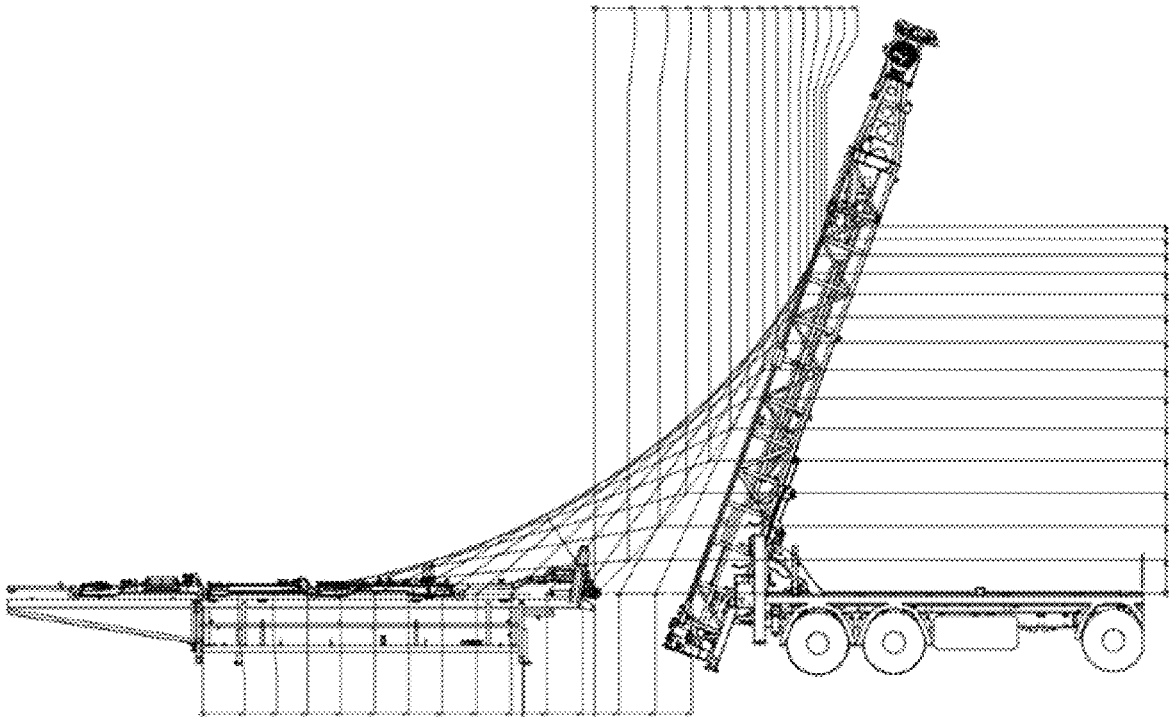
FIG. 31 shows a rod handling system in accordance with the second preferred embodiment of the present invention, located adjacent a drill rig including a drill mast extending at 70 degrees, the rod handling system loading a 6-meter drill rod.
Figure 32:
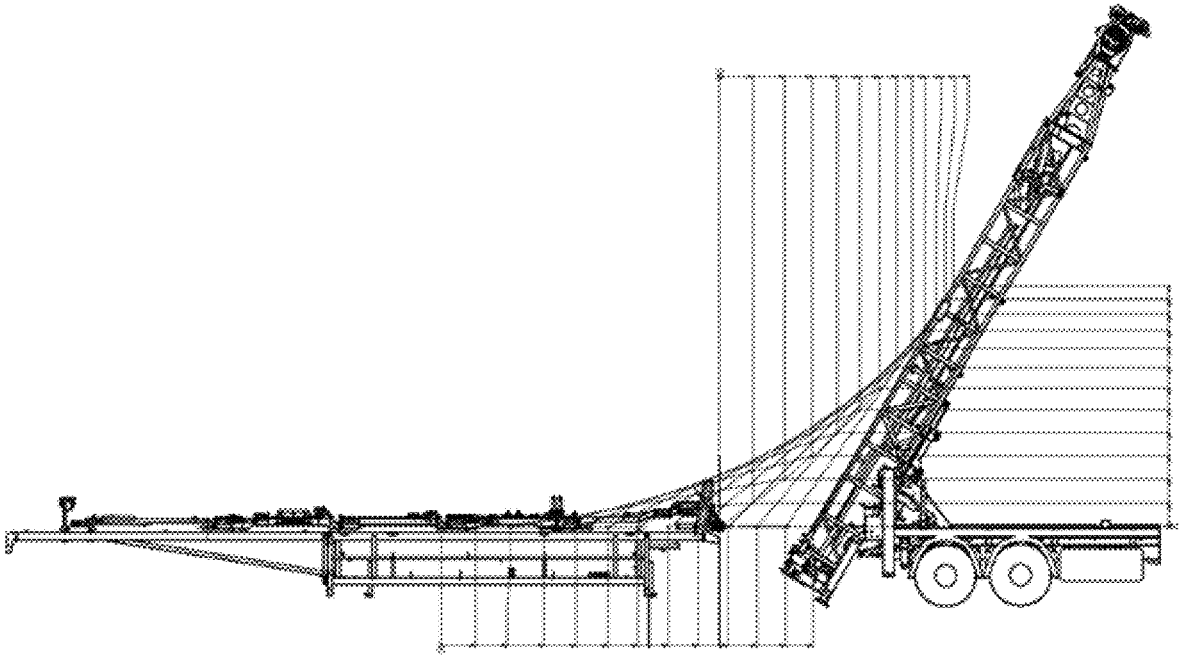
FIG. 32 shows a rod handling system in accordance with the second preferred embodiment of the present invention, located adjacent a drill rig including a drill mast extending at 60 degrees, the rod handling system loading a 3-meter drill rod.
Figure 33:
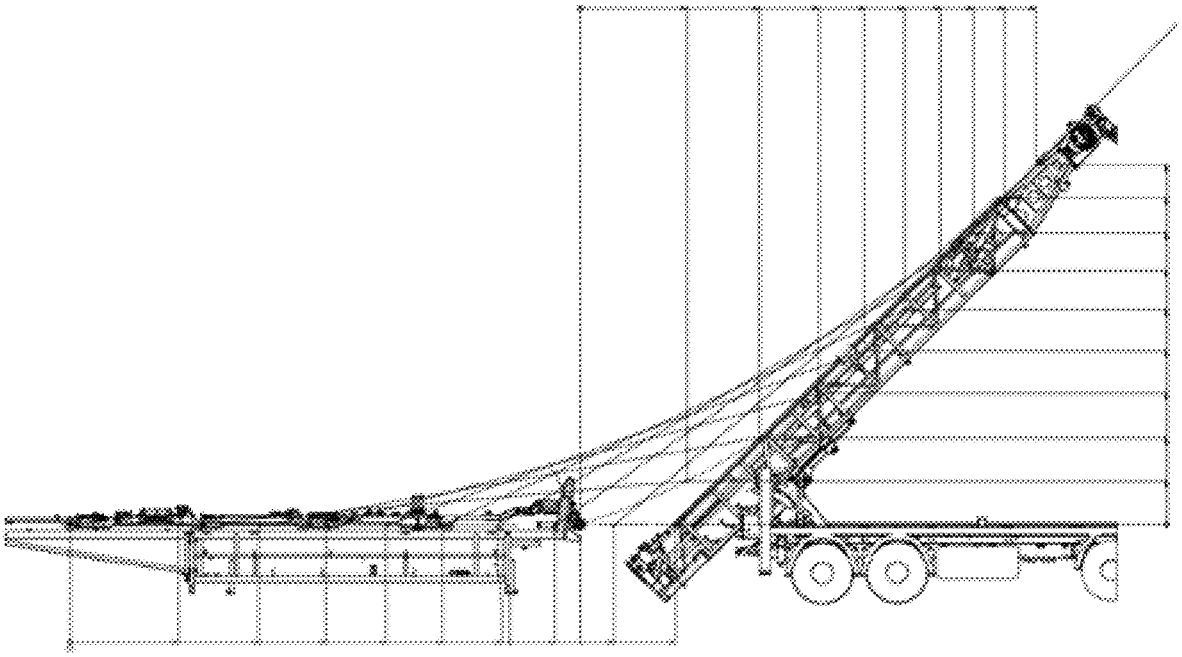
FIG. 33 shows a rod handling system in accordance with the second preferred embodiment of the present invention, located adjacent a drill rig including a drill mast extending at 45 degrees, the rod handling system loading a 9-meter drill rod.

An alternative drive assembly is shown in FIGS. 25 to 29. The alternative drive assembly includes a guide trolley 504' and winch assembly 2500 for driving linkage assembly 502. As best shown in FIG. 29, guide trolley 504' includes a trolley frame 1118' for mounting components of the guide trolley, including idler rollers 1104', wear pads (not shown), hose arm 2902. Trolley frame 1118' and attachment formations, in the form of a first cable connection point 2901 and a second cable connection point (not shown), for connecting guide trolly 504' to winch assembly 2500. Guide trolley 504' further includes a pin, in the form of pull pin 1110', for mounting guide trolley 504' to the fifth sub-assembly 514 of linkage assembly 502 (best shown in FIG. 10).

Figure 25:
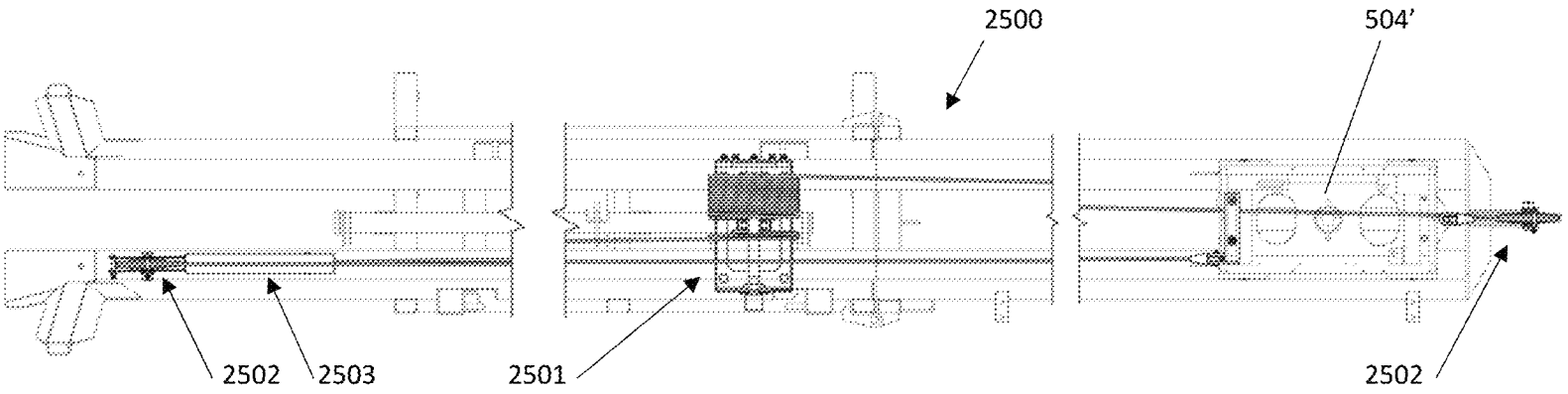
FIG. 25 shows a bottom view of an alternative drive assembly in accordance with a second preferred embodiment of the present invention.
Figure 26:
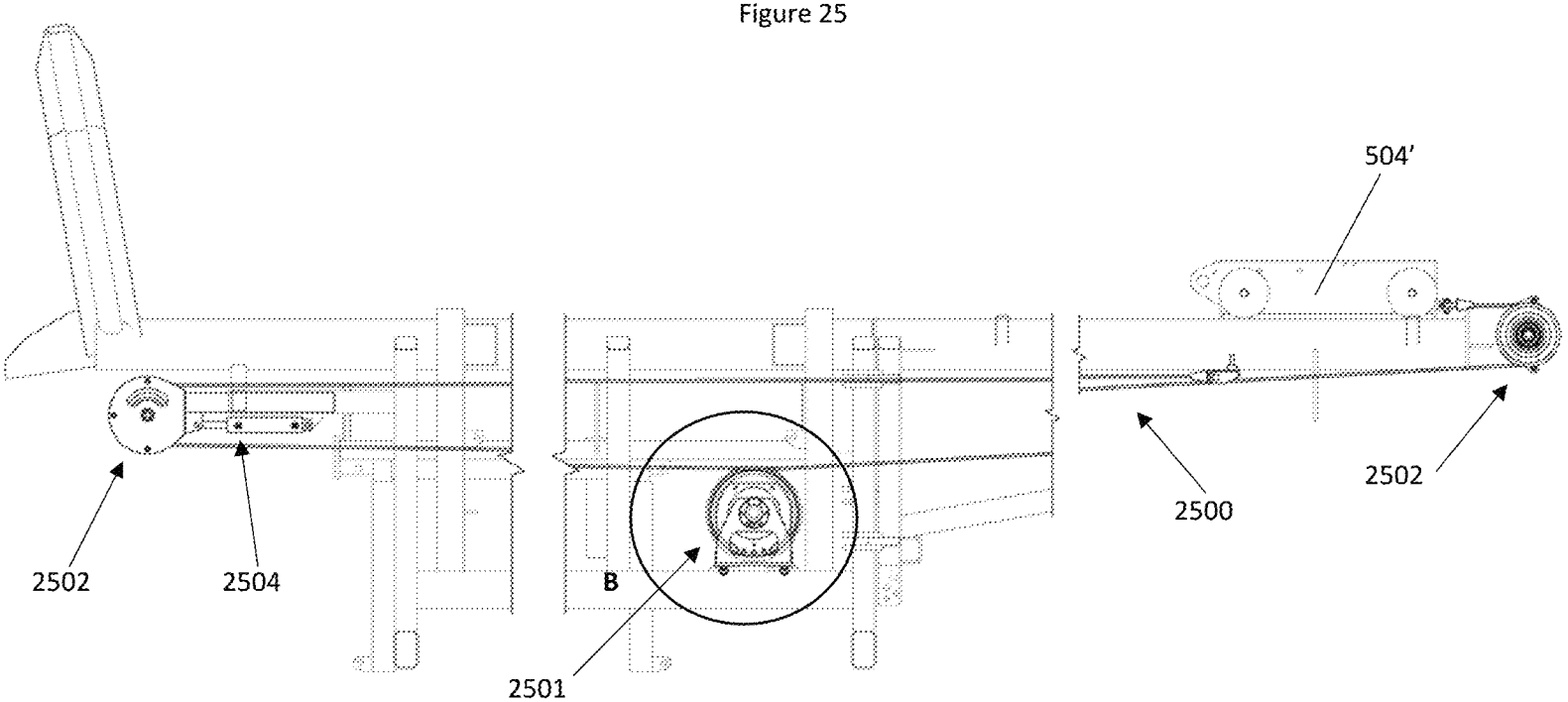
FIG. 26 shows a side view the alternative drive assembly, as shown in FIG. 25, in accordance with the second preferred embodiment of the present invention.
Figure 28:
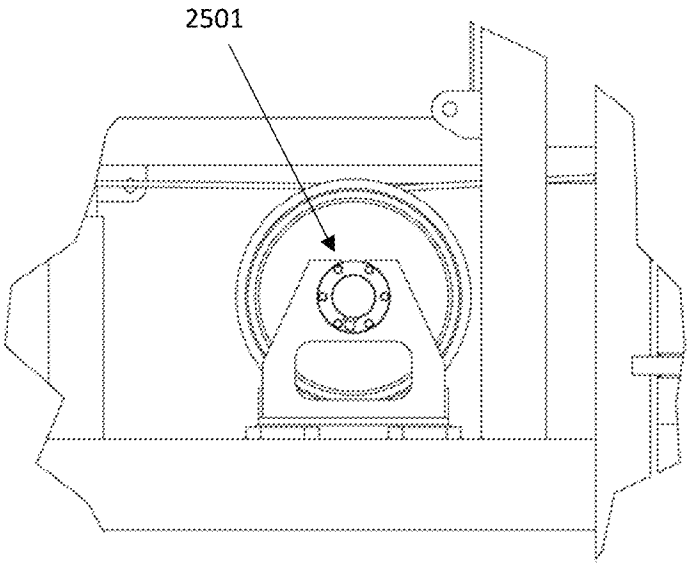
FIG. 28 shows an enlarged view of feature B shown in FIG. 26, in accordance with the second preferred embodiment of the present invention.
Figure 27:
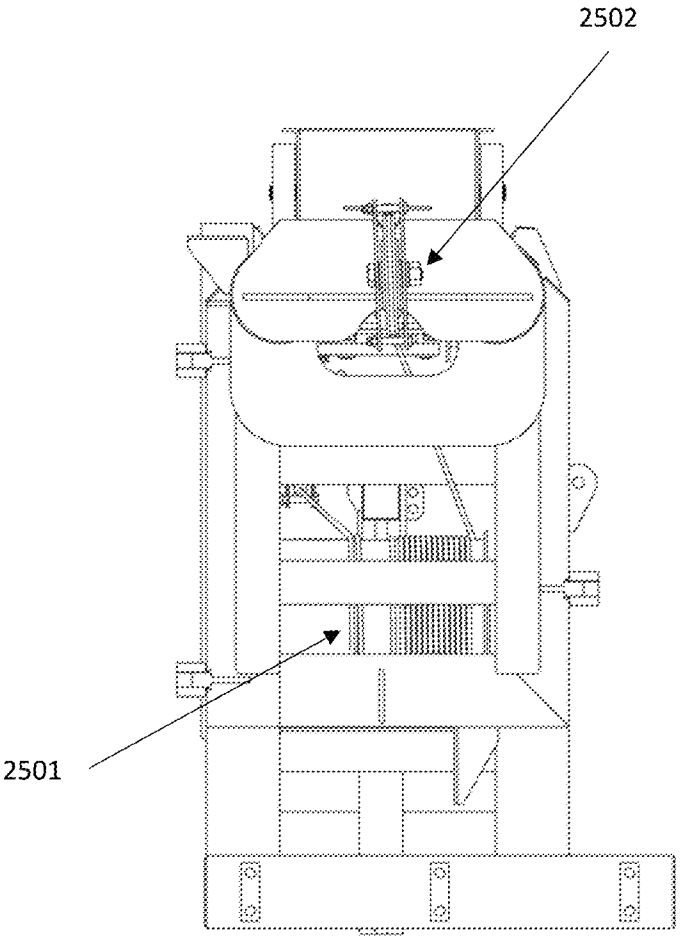
FIG. 27 shows a back view of the alternative drive assembly, as shown in FIGS. 25 and 26, in accordance with the second preferred embodiment of the present invention.

As best shown in FIGS. 25 and 26, winch assembly 2500 includes a two-sided push/pull winch with hydraulic motor drive 2501, a pair of idler sheaves 2502, in the form of a front sheave 2502*a* and a rear sheave 2502*b*, a telescoping tensioning arm 2503 and a pair of cables, in the form of first cable 2505*a* and second cable 2505*b*. Winch assembly 2500 is mounted to frame assembly 304 and rails 303 of base assembly 302. As best shown in FIG. 26, first cable 2505*a* extends from winch 2501 to the front of rail assembly 303, around tensioning sheave 2502*a* and before connecting to the front of guide trolley, and second cable 2505*b* extends to the rear of frame 304, around idler sheave 2502*b* and before connecting to the rear of guide trolley 504'. Each cable 2505*a*, 2505*b* is connected to a drum of winch 2501. In use, winch 2501 is configured such that, as one side spools on to the drum of winch 2501, the other side spools off the drum, providing a push/pull effect on the guide trolley.

Hydraulic cylinder 2504 maintains tension in winch cables 2505*a*, 2505*b*. Winch 2501 is controlled, in conjunction with the main haul winch of drill rig 100, using a programmable logic controller (PLC) to create a rod path. Examples of various rod pathways are shown in FIGS. 30 to 33.

As mentioned above, conveyor assembly 300 includes guide roller assemblies 1300, roller clamp assemblies 1500, a jaw assembly 1400, and stop assemblies 1200.

Figure 13:
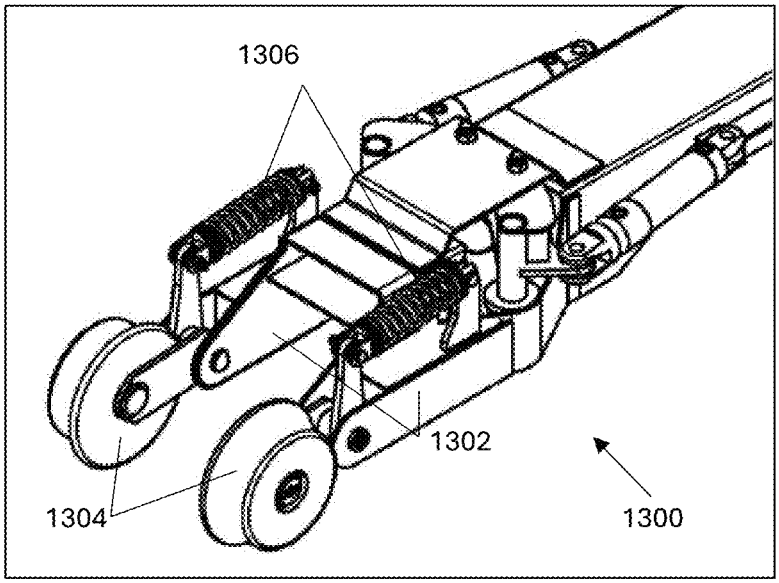
FIG. 13 shows a guide roller assembly in accordance with the preferred embodiment of the present invention.

Turning to FIG. 13, FIG. 13 shows guide roller assembly 1300 including a pair of arms 1302 for mounting a pair of guide rollers 1304; the pair of guide rollers for travel along rails 305; and, a pair of shock absorbers, in the form of springs 1306, for absorbing movement of a respective sub-assembly. As mentioned previously, the second sub-assembly includes a pair of guide roller assemblies 1300*a*, 1300*b*, and each of the third and fourth sub-assemblies 510, 512 include a single guide roller assembly 1300*c*, 1300*d*. Advantageously, the guide rollers assemblies allow the conveyor assembly to travel along rails 305.

Figure 14:
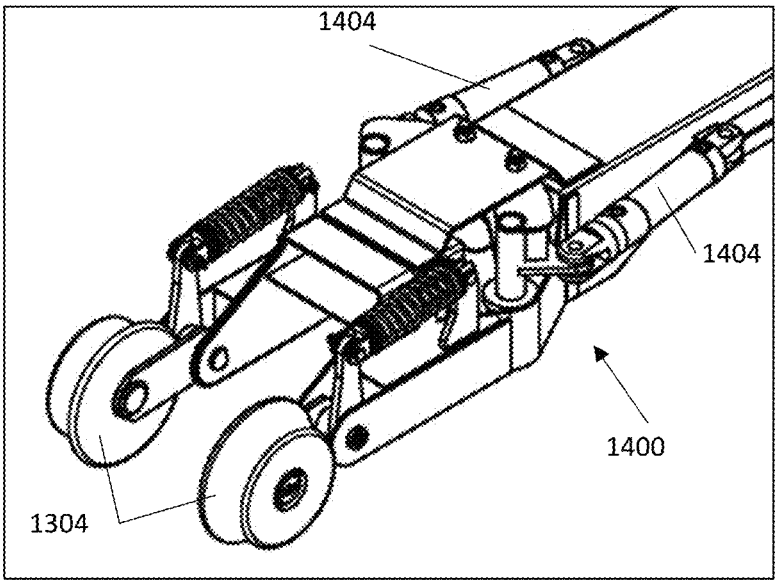
FIGS. 14 and 14*a* show a roller clamp assembly in accordance with the preferred embodiment of the present invention.
Figure 14A:
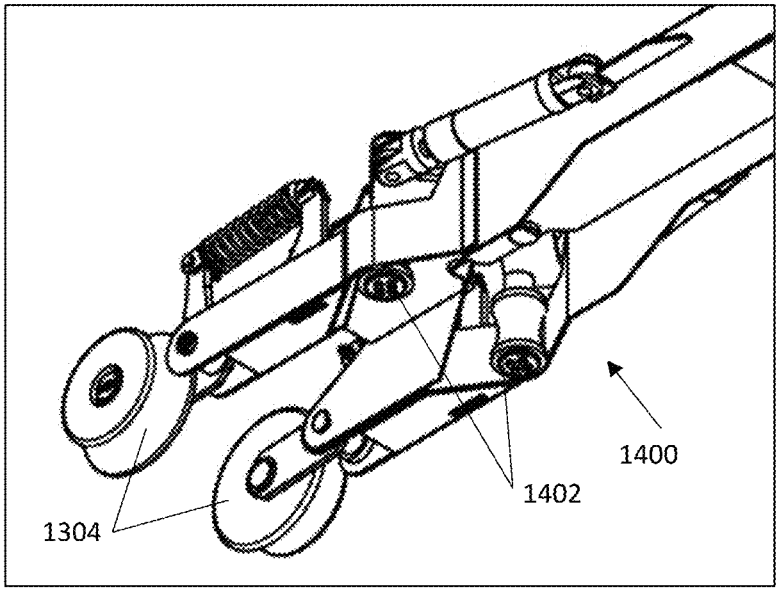

Turning to FIGS. 14 and 14*a*, FIGS. 14 and 14*a* show roller clamp assembly 1500. Each roller clamp assembly 1400 includes a pair of rollers 1402 for hugging or clamping a drill rod or rod segment; and, a pair of hydraulic members, in the form of a pair of hydraulic cylinders 1404, for activating or deactivating the pair of rollers. In the preferred embodiment shown, the pair of rollers are interconnected with gear teeth. Advantageously, the roller clamp assembly holds the drill rod centrally but allows the drill rod to move axially. As previously mentioned, the second and fourth sub-assemblies 508, 512 each include a roller clamp assembly 1400.

Figure 15:
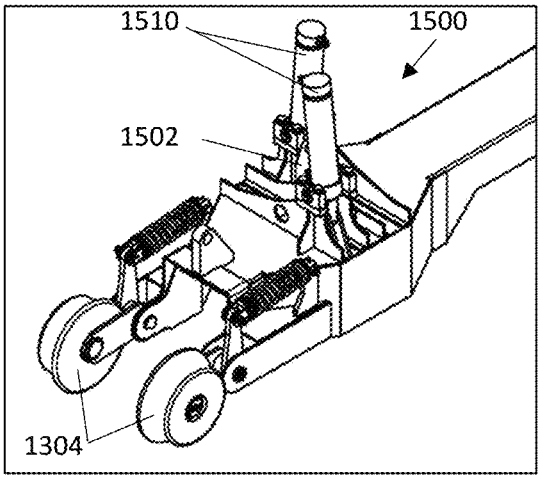
FIGS. 15 and 15*a* show a jaw assembly in accordance with the preferred embodiment of the present invention.
Figure 15A:
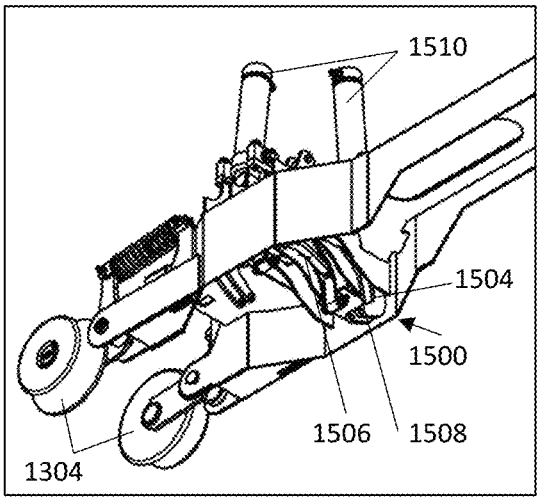

Turning to FIGS. 15 and 15*a*, FIGS. 15 and 15*a* show jaw assembly 1500. Jaw assembly 1500 includes a spring loaded upper chain 1506, a pair of side chains 1508, an adjustable, upper clamp frame 1502 for housing the spring loaded upper chain, and a pair of side clamp frames 1504, each for housing one of the side chains. Jaw assembly 1500 further includes a pair of hydraulic cylinders 1510 for operating the side jaw frames. In the preferred embodiment shown, second sub-assembly 508 includes jaw assembly 1500.

Figure 12:
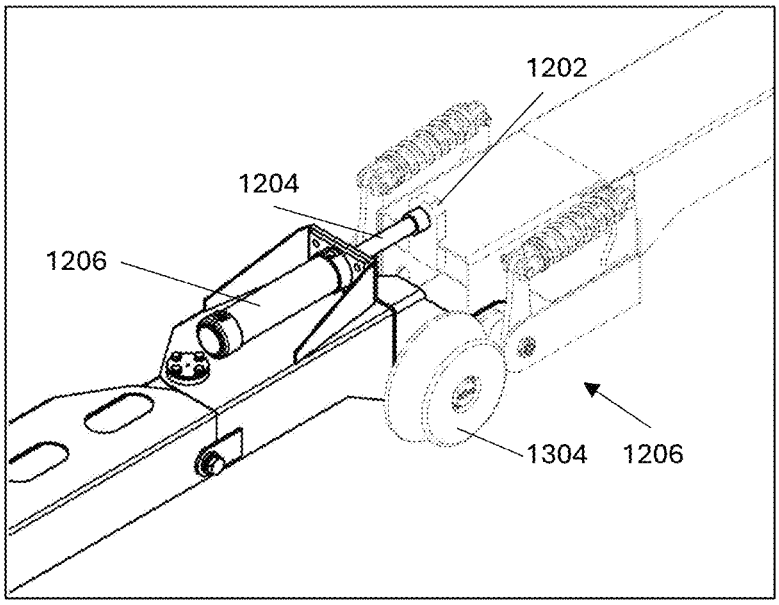
FIG. 12 shows a back bend stop assembly in an activated configuration in accordance with the preferred embodiment of the present invention.

Turning to FIG. 12, FIG. 12 shows stop assembly 1200 including a stop member 1202, an elongate arm 1204 for abutting the stop member when in an activated condition, and a hydraulic cylinder 1206 for moving the elongate arm from a first portion to a second position, wherein the first position is an activated condition which prevents vertical pivoting between adjacent sub-assemblies, and the second position is a deactivated position that prevents vertical pivoting between adjacent sub-assemblies. As can be seen, hydraulic cylinder 1206 and elongate arm 1204 are mounted to one sub-assembly and stop member 1202 is mounted to an adjacent sub-assembly. Accordingly, each stop assembly 1200 acts to prevent vertical pivoting between a pair of adjacent sub-assemblies when in an activated condition but allow pivoting between a pair of adjacent subassemblies when in a de-activated condition. As best shown in FIG. 5, conveyor assembly 306 includes a first stop assembly located between the second and third sub-assemblies, and a second stop assembly located between the third and fourth sub-assemblies.

As mentioned above, rod handling apparatus 300 includes inner tube handling assembly 308. As best shown in FIGS. 3 and 4, inner tube handling assembly 308 is mounted to the frame 304.

Figure 22:
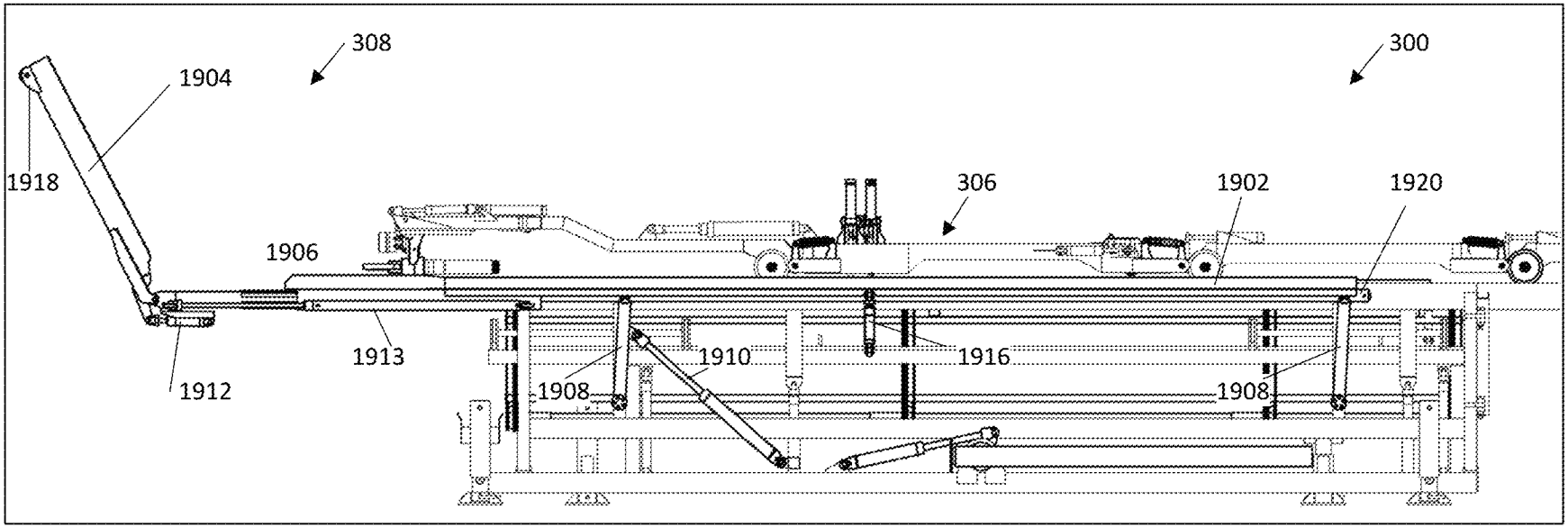
FIG. 22 show a side view of the rod handling system, as shown in FIG. 3, with the inner tube handling assembly in an extended configuration.
Figure 23:
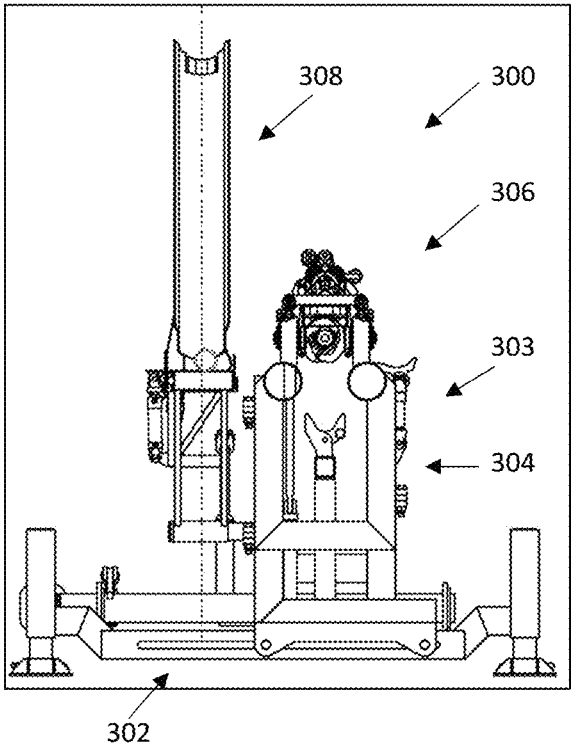
FIG. 23 shows another side view of the rod handling system, as shown in FIG. 3, when the inner tube handling assembly is in alignment with the mast of a drill rig (not shown).

Turning to FIG. 22, inner tube handling assembly 308 includes a primary tray 1902, a secondary tray 1904 and an extension arm 1906 for mounting the secondary tray to the primary tray. Primary tray 1904 may be raised and lowered relative to the frame of the rod handling apparatus, and extended towards and away from the drill rig mast 102, using pivot arms 1908. Primary tray 1904 includes a first end for mounting the secondary tray and a second end having a roller. The primary tray further includes a side wall adapted to be raised and lowered. Secondary tray 1904 includes a first free end including a roller, and a second end for mounting to the extension arm. When in a non-use configuration, the secondary tray rests perpendicular to the primary tray (as best shown in FIG. 4). When in use, secondary tray 1904 is pivotable away from the primary tray (as best shown in FIG. 3) such that the inclination of the secondary tray relative to the primary tray matches the inclination of the drill rig mast 102.

The extension arm 1906 includes a first end for mounting to the secondary arm and a second end for mounting to the primary arm, and, when in use, is adapted to extend the secondary tray away from the primary tray and towards drill rig mast 202.

The inner tube handling assembly includes hydraulic members, in the form of a primary tray hydraulic cylinder 1910 for pivoting the primary tray; a secondary tray hydraulic cylinder 1912 for tilting the secondary tray; an extension arm hydraulic cylinder 1914 for extending or retracting the extension arm; and, a side wall hydraulic cylinder 1916 for raising and lowering the side wall of the primary tray.

Rod handling apparatus 300 further includes a presenter assembly 1300 for presenting a drill rod or rod segment to the conveyor assembly (best shown in FIGS. 13 and 14). The presenter assembly 1300 mounted to frame 304 and positioned under the conveyor assembly 306. The presenter assembly includes a pair of arm assemblies, in the form of a first arm assembly 1302 for receiving or transferring a drill rod or rod segment from a sloop or truck, and a second arm assembly 1304 for presenting or receiving a drill rod or rod segment from the conveyor assembly 306. First arm assembly 1302 includes an arm 1306 and a substantially U-shaped hand 1308 for receiving the drill rod or rod segment from the sloop or truck. U-shaped hand 1308 is pivotable relative to arm 1306 about a central pivot point 1310. The second arm assembly 1304 includes a height adjustable arm 1312 and a substantially U-shaped hand 1314 for receiving the drill rod or rod segment from first arm. U-shaped hand 1314 comprises a first fixed side wall portion 1316 and a second pivotable side wall portion 1318. Side wall portion 1318 is adapted to be lowered when receiving a drill rod or rod segment form the first arm assembly of presenter assembly and is adapted to be raised such that the portions cup the drill rod or rod segment (best shown in FIG. 14).

Figure 4A:
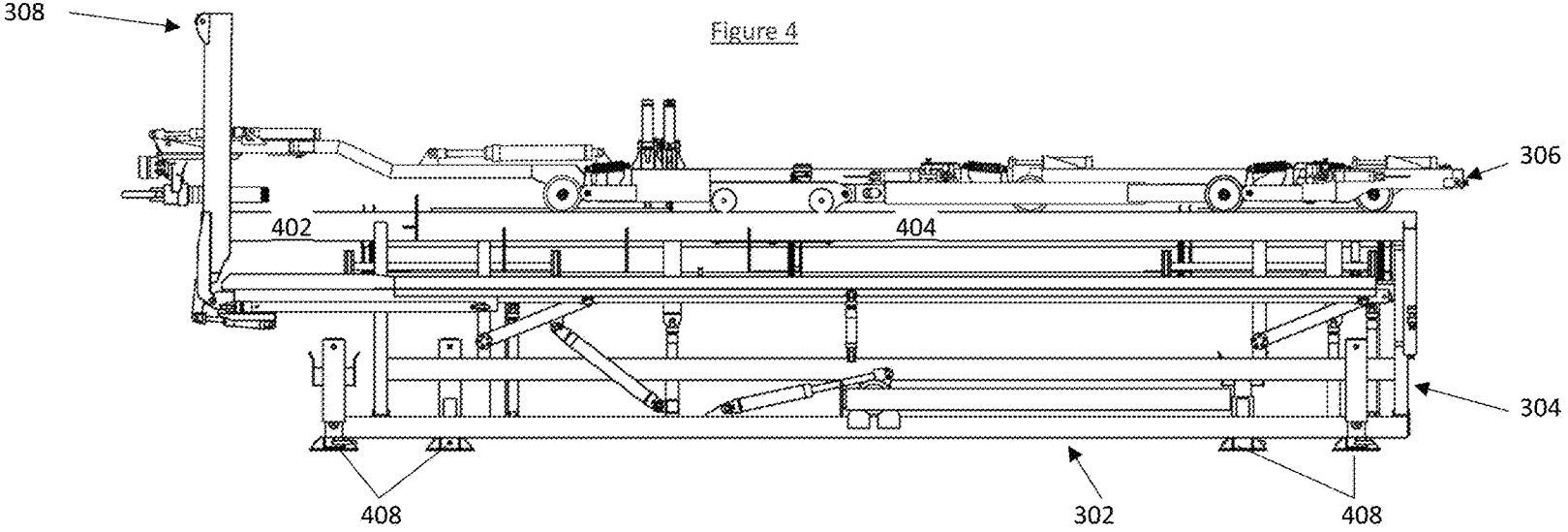
FIG. 4*a* shows a side view of the rod handling system shown in FIG. 3, in a non-use configuration.

Turning to FIGS. 4 and 4*a*, as mentioned above, rod handling apparatus 300 includes a rail assembly 303 which includes elongate rails 305, base assembly 302 for mounting frame assembly 304 and frame assembly 304.

Rail assembly 303 includes a first portion 402 and a second portion 404. First portion 402 is fixed to frame assembly 304 such that manoeuvring of the frame, in turn, manoeuvres rail assembly 303. Each portion 402, 404 is substantially elongate and defines a first end and a second end. In an in-use configuration, the second end of the first portion abut the first end of the second portion (best shown in FIG. 3). The second portion 404, however, is adapted to pivot relative to the first portion. Rail assembly 303 includes hinge member 406 for pivoting the second portion 404 relative to the first portion 402 such that the first portion and the second portion form a U-shape (best shown in FIG. 4). In preferred embodiments, rail assembly 303 further includes a securing mechanism for securing the second portion relative to the first portion (not shown).

Figure 20:
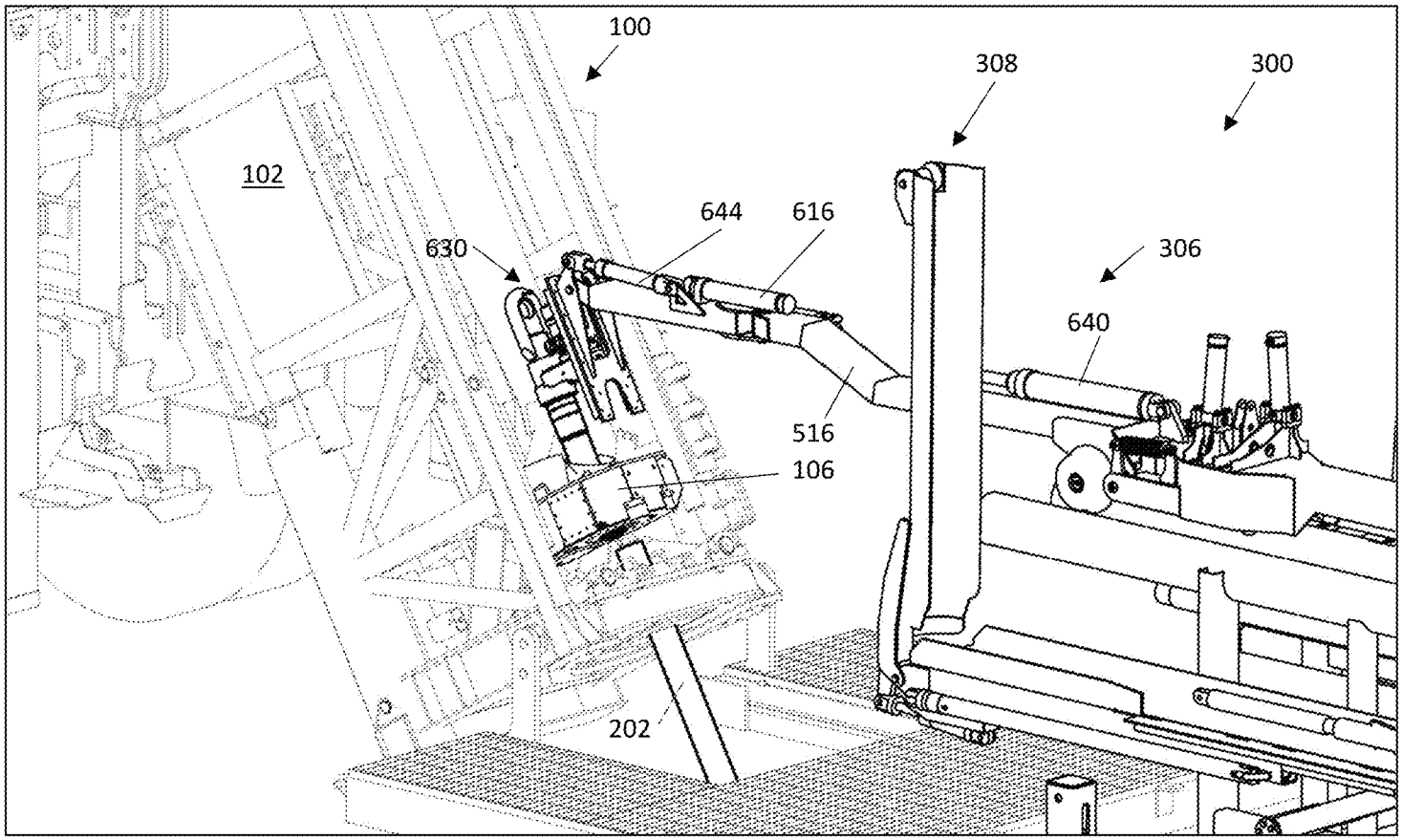
FIG. 20 shows a perspective view of a lower end of a drill mast of a drill rig having a spinner mounted thereto, and a plug being received within the spinner, the plug about to be mounted to an end of the drill string.

Base assembly 302 includes six height adjustable legs, in the form of jack legs 408, and a pair of rails for sliding frame 304 from a first position (shown in FIGS. 13 and 14) to a second position (shown in FIG. 20).

In use, full automatic control of the conveyor assembly 306 relative to drill rig mast 102 is achieved using a controller adapted to receive information from one or more of: the encoder fitted to the drive assembly of the conveyor assembly, speed and/or direction sensors fitted to the hoisting winch of the drill rig, and/or inclinometer fitted to drill rig mast 102. Examples of plots paths for various drill rod lengths relative to various mast angles are shown in FIGS. 30 to 33 (bail 636 coordinate layouts).

The preferred operation of rod handling apparatus 300 will now be described below.

The preferred embodiments of rod handling apparatus 300 has four main functions:

1. Load drill rods into the drill string from the start of a hole progressively, typically in 3 or 6 m lengths;
2. Tripping drill rods out of a drill hole, typically in 6 or 9 m lengths, for bit changes, at the completion of the hole, or for other drilling practices;
3. Tripping drill rods back into the hole, typically in 6 or 9 m lengths;
4. Handling the inner tube in and/or out of the hole.

Load Drill Rods into the Drill String from the Time of Starting a Drill Hole

Figure 16:
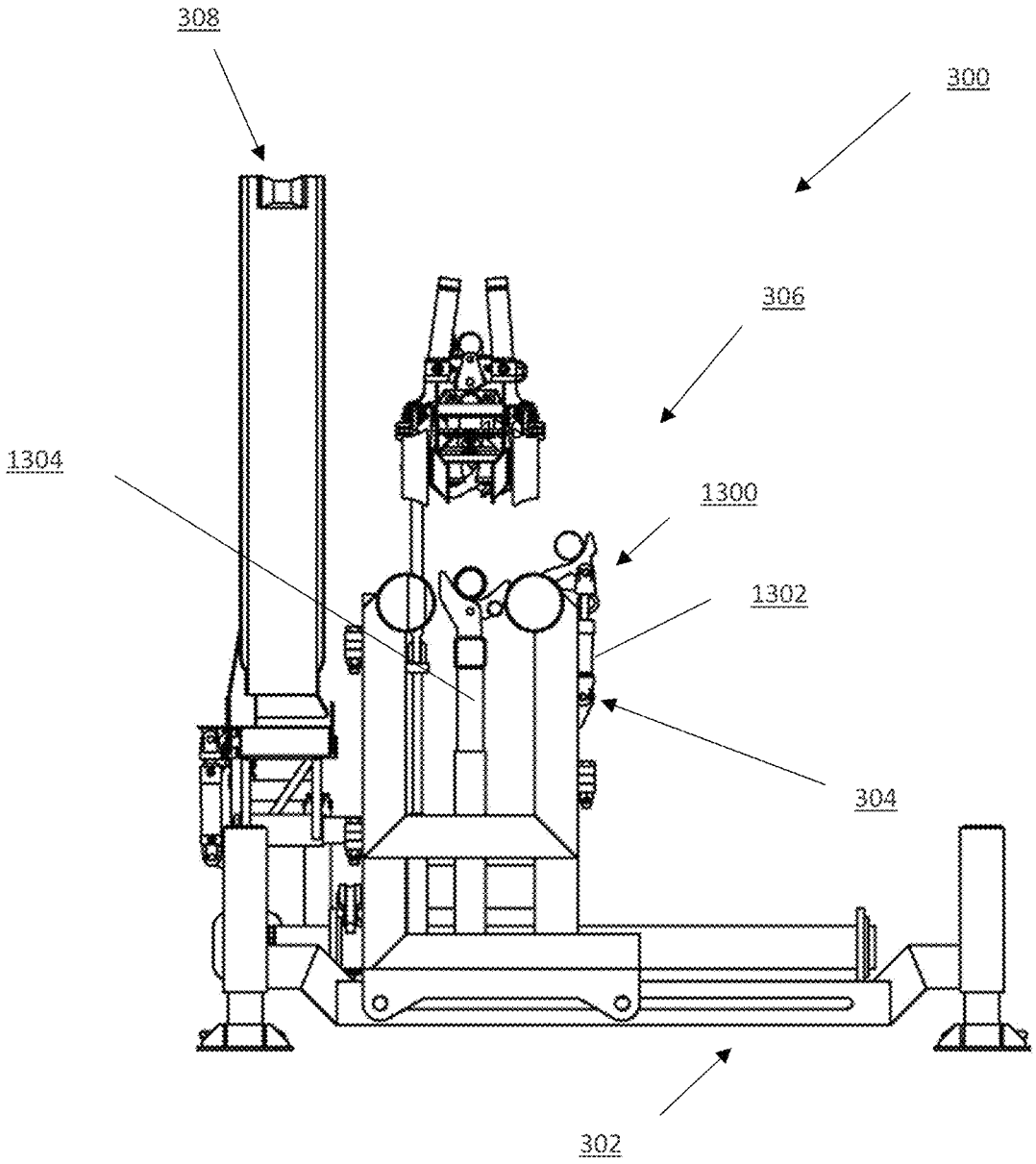
FIGS. 16 and 16*a* show adding a drill rod from a loading sloop, or truck body, to the conveyor assembly.
Figure 16A:
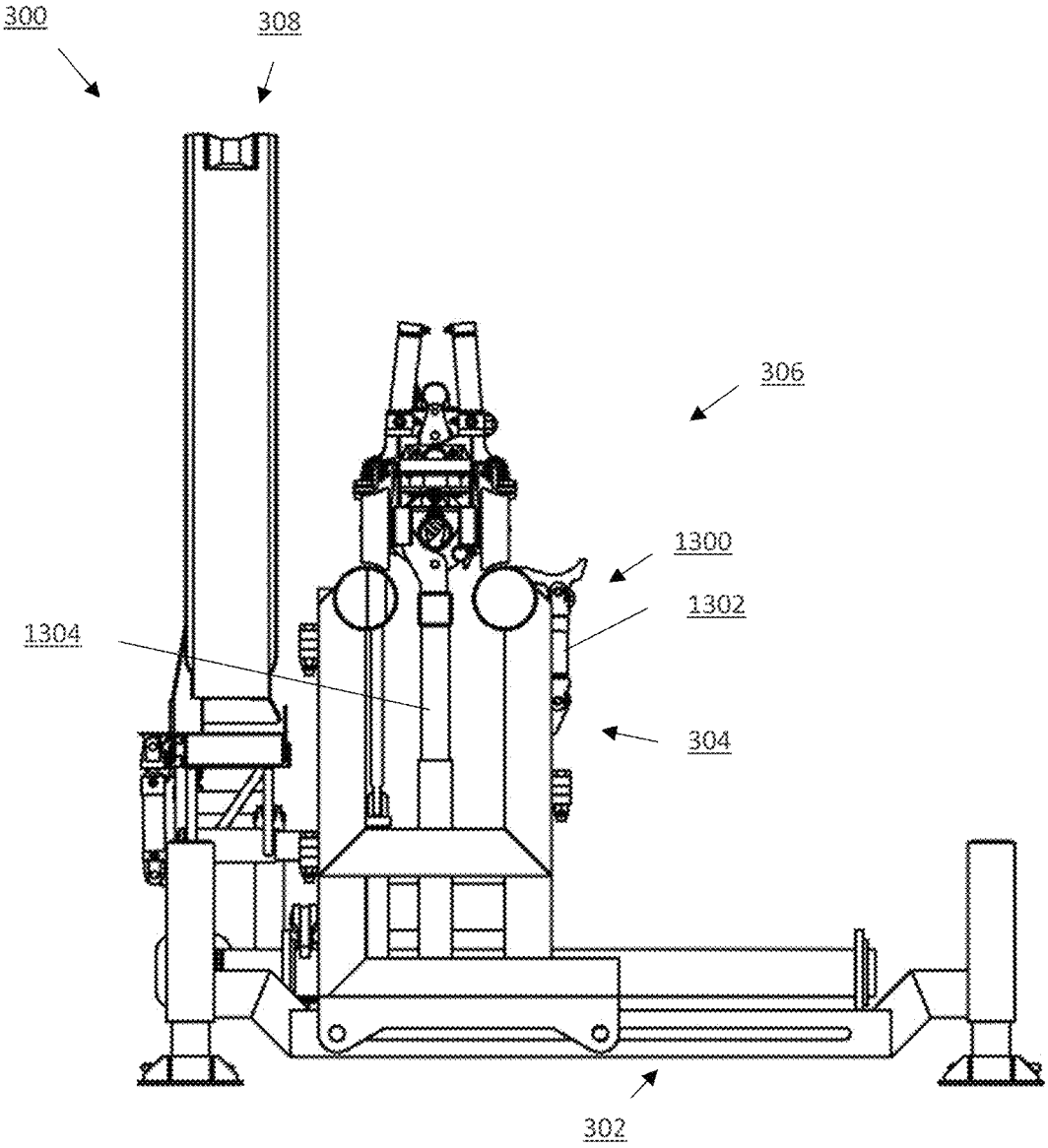
Figure 18A:
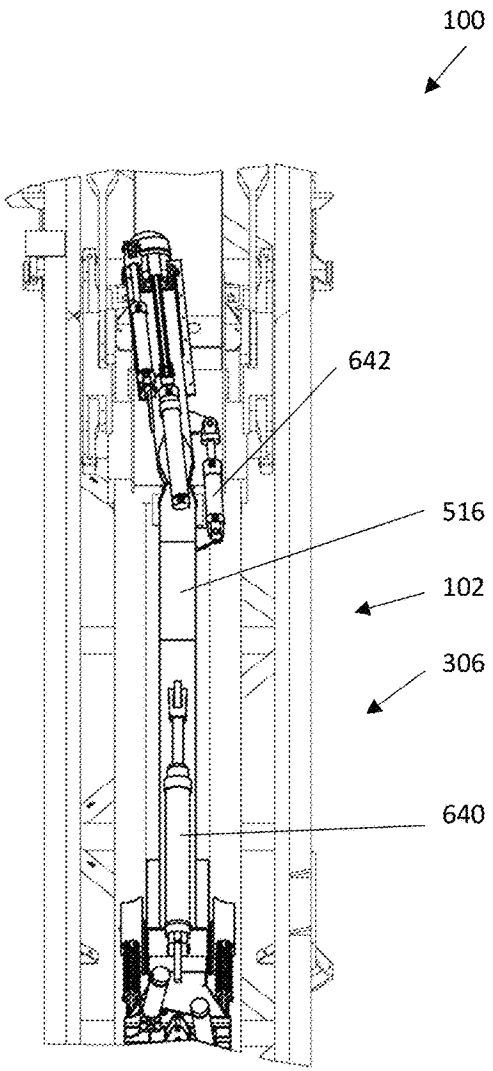
FIGS. 18 and 18*a* show partial side and front perspective views of a drill rod being added to a drill string, under a drill rig rotation head of a drill rig, using the conveyor assembly shown in FIG. 5.
Figure 18:
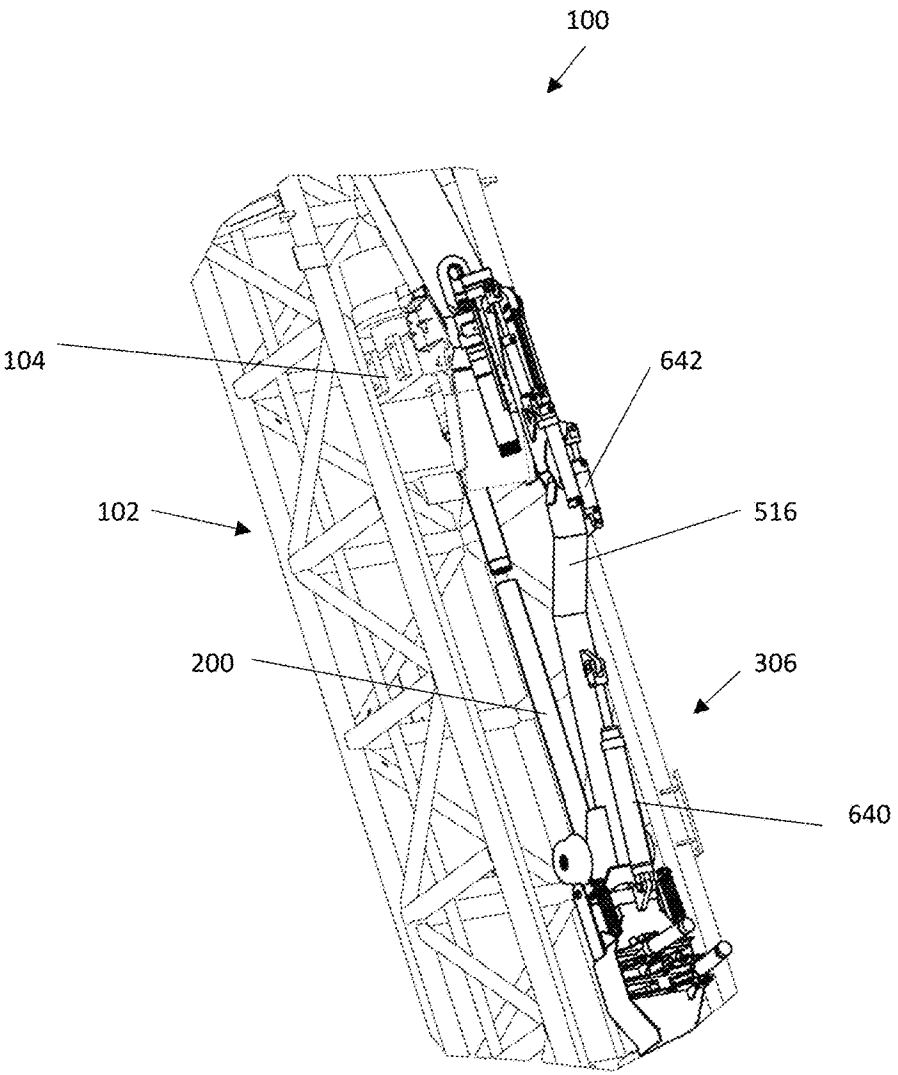
Figure 19:
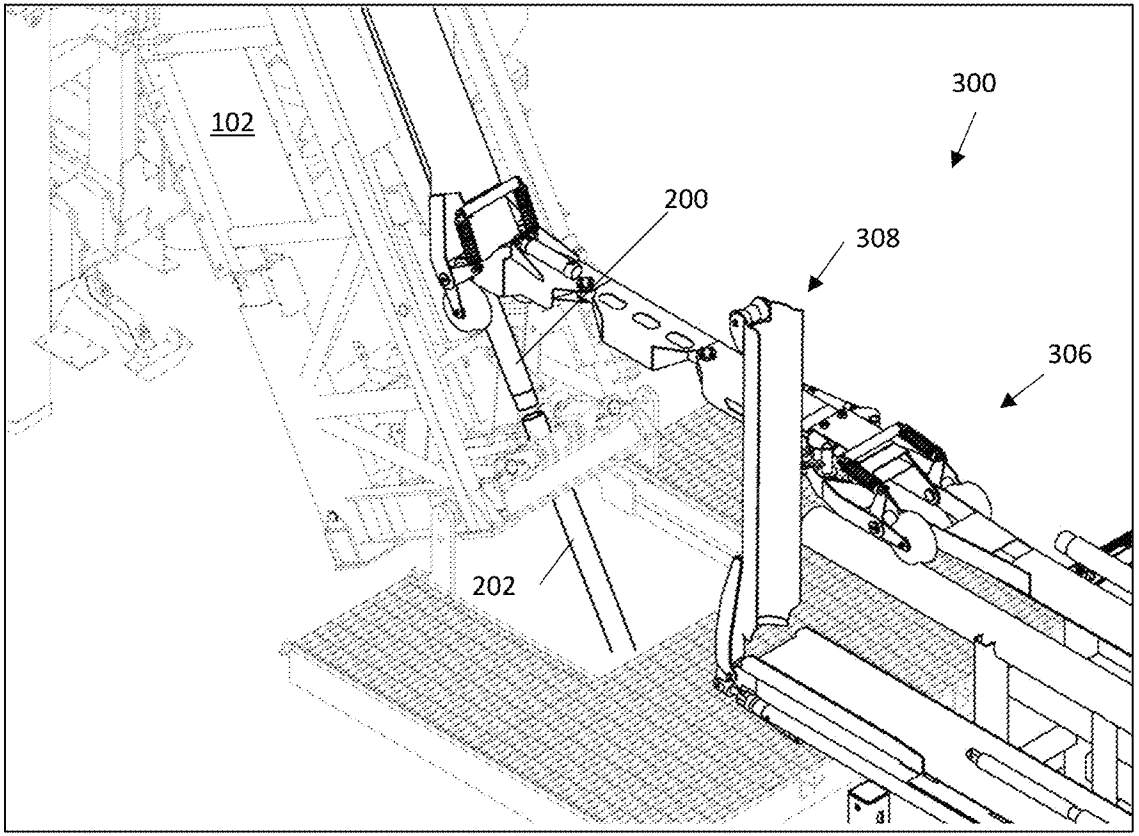
FIG. 19 shows a perspective view of a lower end of a drill mast of a drill rig and portion of the conveyor assembly of the rod handling system securing a drill rod to the drill string, as shown in FIGS. 18 and 18*a*.
Figure 21:
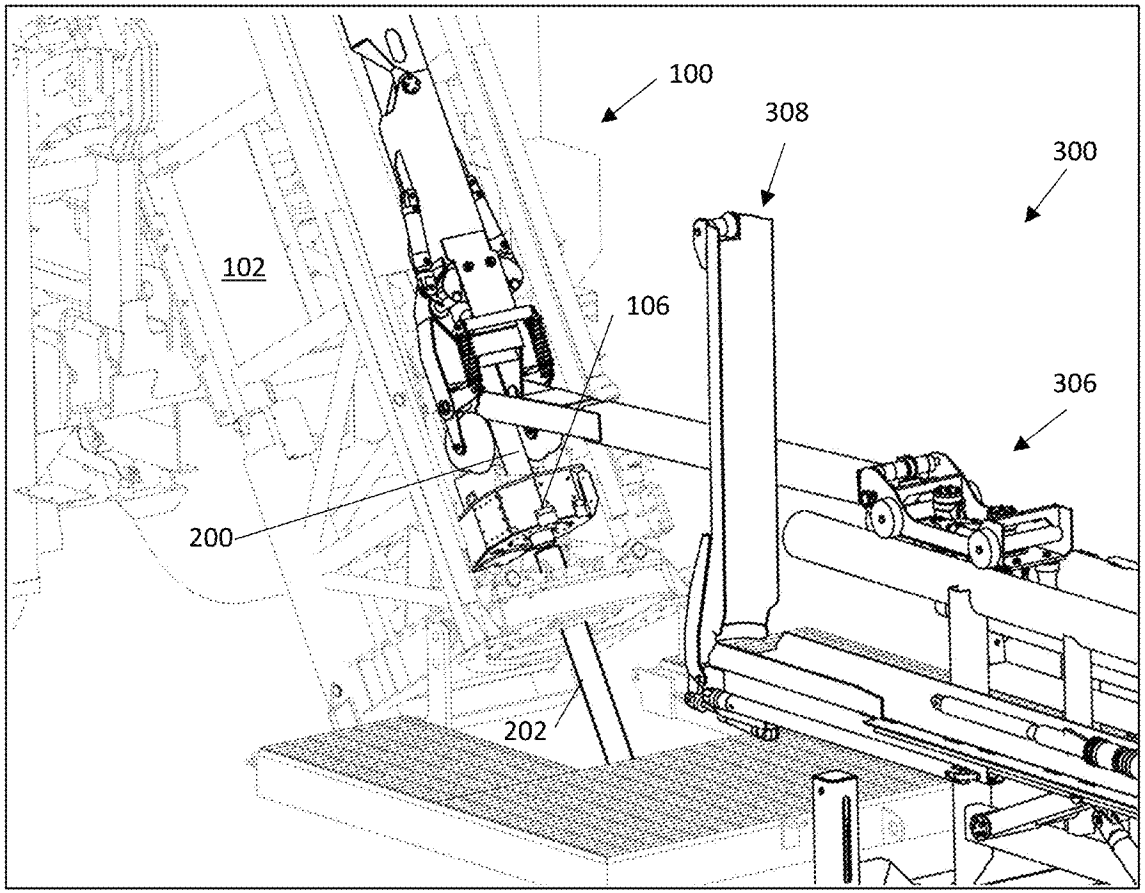
FIG. 21 shows a perspective view of a lower end of a drill mast of a drill rig having a spinner mounted thereto, a drill rod mounted to the conveyor, an end of the drill rod being received within the spinner, in anticipation of the end of the drill rod being mounted to the drill string.

One function of the drill rod apparatus 300 is loading rods onto a drill string from the time of starting a drill hole. During this process, a rotation head 104 of the drill rig is raised and racked into the drill rig mast 102 prior to adding a drill rod 200 (or rod segment) under the head. As best shown in FIGS. 16 and 16*a*, a drill rod 200 is transferred from a feed in system, in the form of a sloop or truck body (not shown), to the rod presenter assembly 1300. Drill rod 200 is raised vertically using presenter assembly 1300 and clamped by roller clamp assemblies 1500*a*, 1500*b* and jaw assembly 1400 of conveyor assembly 306. During this function, drill rod 200 is not connected to the hoist assembly 608. Second, third and fourth sub-assemblies 508, 510, 512 are locked using stop assemblies 1200*a*, 1200*b* such they form a single rigid member during loading. Conveyor assembly 306 is then hauled onto drill rig mast 102 by a main winch (not shown) until substantially positioned along the drill rig mast and under the rotation head (as best shown in FIGS. 18 and 18*a*). Many known drill rigs have top mounted haul winches. As such, the winch rope reeves from left to right and the alignment of conveyor assembly 306 will be to the left side of a mast centre line when the winch rope is positioned above rotation head 104. For this reason, cylinder 640 is floated and drill rotation head 104 moved from racked back into the mast to a forward position. By articulating hydraulic cylinders 640 and 642, rotation head 104 is alignable with the drill rod 200, and rotation head 104 is able to be lowered in order to connect with drill rod 200. The position of the lower end of conveyor assembly 306, relative to drill rig mast 102, may be adjusted using hydraulic cylinder 1006 of fifth sub-assembly 514, and (optionally) side movement cylinder 1114 of drive trolley 504. Once rod 200 is connected to rotation head 104, jaw assembly 1400 is released (while roller clamp assemblies 1500*a*, 1500*b* are maintained engaged). Rotation head 104 lowers and facilitates joining of drill rod 200 to drill string 202 (shown in FIG. 21). Roller clamp assemblies 1500*a*, 1500*b* are released, and conveyor assembly 306 is lowered back onto frame assembly 303 by the winch and with a constant tension using the drive assembly, in the form of drive trolley 504 or guide trolley 504' and winch assembly 2500.

Tripping Rods Out of a Drill Hole

Figure 17:
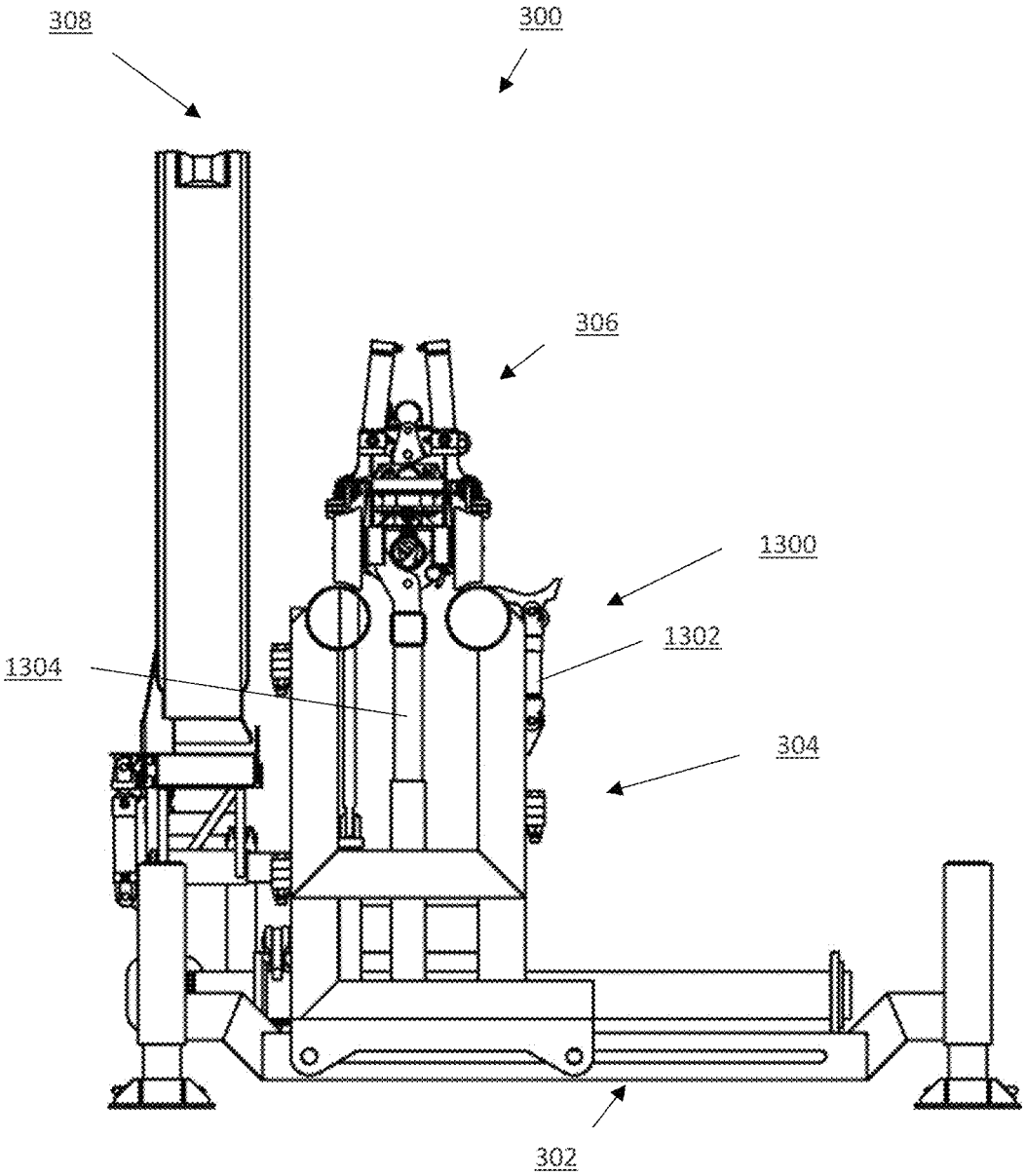
FIGS. 17 and 17*a* show removing a drill rod from the conveyor assembly to loading sloop or truck body.
Figure 17A:
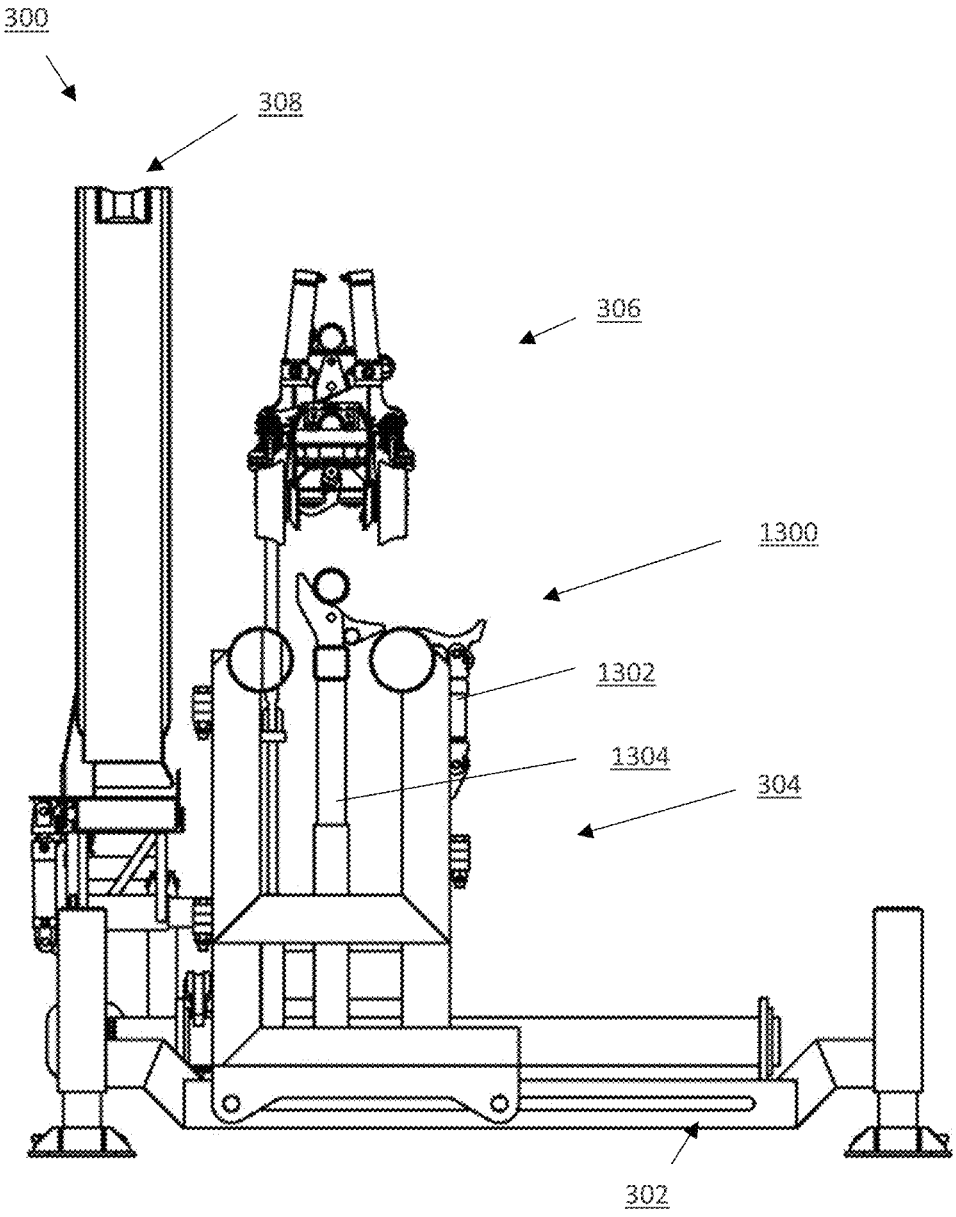

Another function of the drill rod apparatus 300 is tripping drill rods out of a drill hole. During this process, rotation head 106 is disconnected from drill string 202 leaving the drill string open but clamped at the base of the drill rig mast (best shown in FIG. 20). Rotation head 106 travels to the top of the mast and racks fully thereto. The hoist assembly 630 is tilted such that the hoist assembly centreline 634 (see FIG. 6) defined by the plug matches the mast inclination. The hoist assembly 630 holds its angled angle position hydraulically via a holding valve with a low pressure setting. Conveyer assembly 306 is then driven forward toward drill rig mast 102 using the drive assembly, in the form of drive trolley 504 or guide trolley 504' and winch assembly 2500, and positioned above spinner 106 using cylinder 1006 of fifth sub-assembly 514 (see FIG. 10). Float body 614 of first sub-assembly 506 is passed through the inside of spinner 106 using cylinder 616 of hoist assembly 630 also with a low set holding valve until plug 620 connects with the end of clamped drill string 202. The connection of cylinder 616 to the hoisting assembly is via a push pull chain 618. This allows the float body 614 to slide up or down a set of low friction guides located on frame 612. Once plug 620 is connected to the end of drill string 202, the drill rig (i.e. hoisting) winch balances the drill string weight, clamps holding the end of drill string 202 are released and end of drill string 202 and conveyor assembly 306 are hauled up drill rig mast 102. Due to the low pressure setting for cylinders 616 and 644 they both move relative to the load reactions. Once a drill string joint is clear of the drill rig clamps (best shown in FIG. 20) the clamps are reapplied. Roller clamp assemblies 1400*a* and 1400*b* are also engaged along the length of the drill string 202 now mounted to the conveyor assembly 306. Spinner 106 subsequently breaks a lower joint separating a rod segment 200 from drill string 202, and the separated rod segment 200 is raised through spinner 106. After clearing spinner 106, the drive assembly, in the form of drive trolley 504 or guide trolley 504' and winch assembly 2500, and the drill rod mast winch work together to haul and lower the conveyor assembly 306 and rod segment 200 along rails 305 of frame assembly 304. When the conveyor assembly 306 is fully positioned on rails 305, hoisting drive 622 rotates and disconnects plug 620 from rod segment 200, and moves away therefrom. As best shown in FIGS. 17 and 17*a*, the presenter assembly 1300 is raised and supports the rod segment 200. Rod segment 200 is then released from the clamp assemblies 1400*a* and 1400*b*, and the conveyor assembly 306 is raised along its length with the exception of sub-assembly 514 and drive assembly in the form of drive trolley 504 or guide trolley 504' and winch assembly 2500. The portion 1318 of presenter assembly 1300 drops and the rod segment rolls out from under the conveyor assembly 306. The raised portion of the conveyor assembly is lowered back onto rails 305 and the cycle is repeated.

Tripping Rods into a Drill Hole

Another function of the drill rod apparatus 300 is tripping rod into the drill hole. The process is essentially the same as tripping rids into the drill hole, however the process is reversed. Beginning, from the rod segment 200 being presented to the conveyor assembly 306 by the presenter assembly 1300, the drill rod or rod segment is clamped along its length using roller clamp assemblies 1400*a* and 1400*b* and jaw assembly 1500, and is mounted to the hoisting drive via plug 620. All stop assemblies 1200 are in an active condition to prevent bending of the drill pipe 200. The conveyor assembly 306 along with the drill rod 200, or rod segment, is then hoisted into the drill rod mast 202 with the drive assembly, in the form of drive trolley 504 or guide trolley 504' and winch assembly 2500, holding back using either drive trolley 504 using a pre-set hydraulic controlled force or guide trolley 504' and winch assembly 2500 with pre-set paths controlled by a controller, in the form of a programmable logic controller (PLC), using feedback from the hoisting winch on the drill rig and a winch assembly encoder. Drill rod end positioning is achieved using the fifth sub-assembly 514. The drill rod or rod segment then is lowered through the spinner 106 using float body 614and the lower end of the drill rod or rod segment is joined to the end of the drill string 202 using spinner 106 (see FIGS. 18 and 18*a*). A clutch in the hoisting drive allows the drive to rotate freely so as not to undo the thread if the drill segment comprises multiple drill rods connected together.

Handling an Inner Tube

Figure 24:
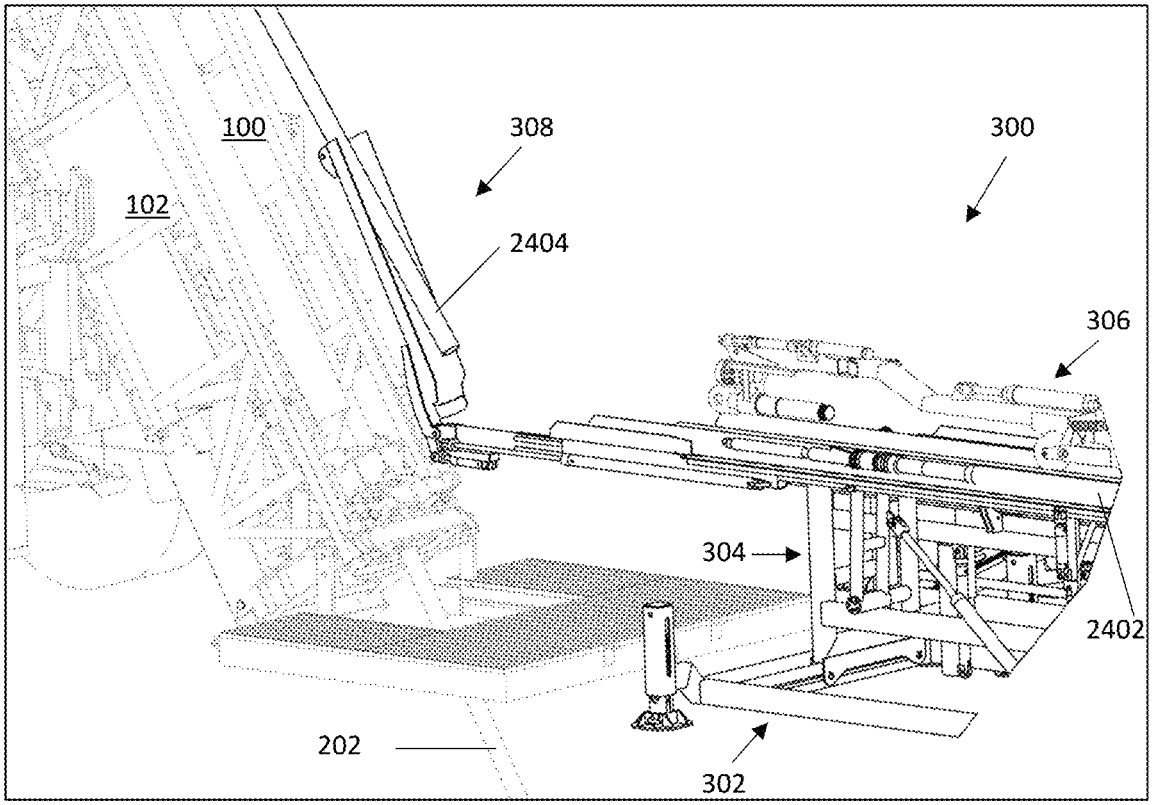
FIG. 24 shows a perspective view of an inner tube being transferred from a mast to the inner tube handling assembly of the rod handling system, as shown in FIG. 22.

Another function of the drill rod apparatus 300 relates to handling an inner tube. When removing a full inner tube through the drill string it is normal to also have a fully assembled tube ready to replace it so the drilling cycle can start again. For this reason, primary tray holds a fully assembled inner tube 2402 in an innermost recess of the primary tray (as best shown in FIG. 24). The full inner tube 2402 is presented to the outer slide side, in the form of primary tray 1902. There is a roller 1920 at the end of primary tray 1902.

As best shown in FIG. 22, when the secondary tray 1904 is fully up and projected towards the drill rig mast 102 tilt cylinder 1912 matches the mast inclination angle. The secondary tray 1904 has a hole in its base to allow the wireline rope, overshot and tube to pass through. In the preferred embodiment shown, a side wall of primary tray 1902 can drop hydraulically using hydraulic cylinder 1916 to allow an assembly to be rolled across to a bench (not shown) located to the left hand side (LHS) for dis-assembly and core removal. The process for retrieving a core sample after drilling a rod length is described below.

Step 1: Breakout the rotation head 104 and leave the drill string 202 clamped at the base of the mast 102. Rotation head 104 then travels to the mast top and racks into the mast, or for some drill rigs to the side.

Step 2: With reference to FIG. 22, cylinder 1910 rotates the primary tray 1902 up and towards the mast. The cylinder 1912 is set to match the mast angle and cylinder 1913 extends the extension arm 1906 toward drill rig mast 102 and over the clamped pipe end 202.

Step 3: An overshot and wireline winch rope (not shown) can then work through this hole to retrieve the inner tube 2404.

Step 4: As best shown in Figured 24, once the inner tube 2404 is pulled clear through the pipe 202 the extension arm 1906 retracts using cylinder 1913 back toward the primary tray 1902.

Step 5: This allows the full inner tube 2404 to slide down tray 1920 as the wireline winch lowers it. The assembled tube length 2404 can be up to 8 m long. A roller 1920 at the end of tray 1902 helps to slide the tube.

Step 6: The overshot is removed from the full assembly 2404 and inserted and latched into the empty assembly 2402 and the procedure reversed.

Advantages of Preferred Embodiment

Advantages of the preferred embodiment of the present invention are described below:

- Using a linked system with incorporated hoisting drive to carry the tools required for handling multiple sizes and lengths of drill pipe and casing.
- Incorporating the rod handling apparatus into a total racking solution hands free.
- The link assembly includes hoisting drive; pipe grabbers, in the form of the jaw assembly and clamp assembly; drive assembly, in the form of a guide trolley and winch assembly; and, link thrust adjuster, in the form of the fifth sub-assembly.
- Upper grabber mechanism, in the form of the jaw assembly, handles pipe sizes from BQ pipe (55.6 mm OD) to 170 mm OD with a threaded rod allowing an infinite adjustment between the ranges stated above.
- Concept of making link members free rotating at their joints or anti-backbend when required for different functionality.
- Rod presenting device, in the form of the presenter assembly, with ability to add or remove rods from or to the main linked handler, in the form of the conveyor assembly.
- Inner tube handling mechanism, in the form of the inner tube handling assembly, to allow for hand free handling for both the inner tube assembly and overshot, and delivering to a work bench by rolling to the LHS for core removal and dis-assembly.
- Rod handling apparatus has the flexibility to fold into a transportable envelope.
- Ability to contain pipe thread make or break torque within the upper link 1 assembly, in the form of the first sub-assembly, and the link 2, i.e. second sub-assembly, chain clamping mechanism.
- Ability to align fine square threads without external tooling.
- Ability to trip rods in 3, 6 or 9 m lengths to 114.3 OD.
- Ability to load 3 and 6 m lengths under the head hands free. Advantageously, the upper link, in the form of the first sub-assembly, provides means to align the threads with the head, which is critical as the winch reeves from RHS to LHS of its drum therefore changing the winch centreline.
- Ability to handle 6 m casing sizes to 6⅝" OD.
- The rod handling apparatus may be integrated into a total system with a rod sloop feeder design or used in conjunction with tilting rod racks.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the scope of the invention.

The invention claimed is:

1. A rod handling apparatus for a drill rig comprising a drill rig mast and a hoisting winch, the rod handling apparatus including:

a base assembly;

a frame assembly coupled to the base assembly, the frame assembly comprising a pair of rails along which a conveyor assembly is adapted to travel along, and the conveyor assembly adapted to be coupled to the hoisting winch for conveying a drill rod up and/or down the drill rig mast such that the drill rod is attachable to and/or detachable from a drill string, the conveyor assembly comprising a linkage assembly and a drive assembly cooperatively configured with one another to drive the linkage assembly, and the drive assembly comprising a guide trolley and a winch assembly cooperatively configured with one another to winch the guide trolley along the pair of rails.

2. The rod handling apparatus as recited in claim 1, wherein the conveyor assembly comprises a plug configured to secure to an end of the drill rod.

3. The rod handling apparatus as recited in claim 1, wherein the conveyor assembly further comprises one or more roller clamp assemblies and/or a jaw assembly.

4. The rod handling apparatus as recited in claim 1, wherein the linkage assembly comprises one or more sub-assemblies adapted to pivot vertically relative to one another.

5. The rod handling apparatus as recited in claim 4, wherein the at least one of the one or more sub-assemblies comprises: a body comprising a first portion, a second portion and a third portion, the second and third portions adapted to pivot horizontally relative to the first portion, and the body being adapted to be assume an elongate configuration and a U-shaped configuration.

6. The rod handling apparatus as recited in claim 4, wherein the at least one or more sub-assemblies comprises: a first sub-assembly, a second sub-assembly, a third sub-assembly, a fourth sub-assembly and a fifth sub-assembly, the first sub-assembly comprises a first end configured to mounting to the drill rod and a second end configured to pivotally mount to the second sub-assembly; the second sub-assembly comprises a first end configured to mount to the first sub-assembly and a second end configured to mount to the third sub-assembly or fourth sub-assembly; the third sub-assembly comprises a first end configured to mount to the second sub-assembly and a second end configured to mount to the fourth sub-assembly; the fourth sub-assembly comprises a first end configured to mount to the third sub-assembly or second sub-assembly and a second end configured to mount to the fifth sub-assembly; the fifth sub-assembly a first end configured to mount to the fourth sub-assembly and a second end configured to mount to the drive assembly.

7. The rod handling apparatus as recited in claim 4, wherein the conveyor assembly further comprises one or more guide roller assemblies adapted to travel along the pair of rails, and/or one or more stop assemblies adapted to prevent vertical pivoting between adjacent sub-assemblies.

8. The rod handling apparatus as recited in claim 1, further comprising a rail assembly, the rail assembly comprising the pair of rails.

9. The rod handling apparatus as recited in claim 8, wherein the rail assembly comprises a first portion and a second portion, the first portion being fixed to the frame assembly, and the second portion adapted to pivot relative to the first portion.

10. The rod handling apparatus as recited in claim 1, further comprising an inner tube handling assembly mounted to the frame assembly.

11. The rod handling apparatus as recited in claim 1, further comprising a presenter assembly configured to present the drill rod, or a rod segment comprising the drill rod, to the conveyor assembly; the presenter assembly being mounted to the frame assembly.

12. The rod handling apparatus as recited in claim 1, wherein the rod handling system is disposable into an operative or in-use configuration and a non-operative or non-use configuration.

13. The rod handling apparatus as recited in claim 12, wherein the conveyor assembly is configured to assume a U-shaped configuration when the rod handling system is in the non-operative or non-use configuration, and the conveyor assembly is configured to assume a substantially elongate configuration when the rod handling system is in the operative or in-use configuration.

14. The rod handling apparatus as recited in claim 12, wherein the rail assembly is configured to U-shaped configuration when the rod handling system is in the non-operative or non-use configuration, and the rail assembly is configured to assume a substantially elongate configuration when the rod handling system is in the operative or in-use configuration.

15. The rod handling apparatus as recited in claim 1, further comprising a controller configured to control the winch assembly and the hoisting winch to create a rod path.

16. The rod handling apparatus as recited in claim 15, wherein the controller is further configured to control the winch assembly based on feedback from the hoisting winch and the winch assembly.

17. A method for conveying a drill rod to and/or from a drill rig, the drill rig including a drill rod mast, hoisting winch and a drill rotation head and/or spinner, the method comprising:

using one or more clamp assemblies to couple the drill rod to a conveyor assembly, coupling the conveyor assembly to the hoisting winch, the conveyor assembly comprising a linkage assembly and a drive assembly cooperatively configured with one another to drive the linkage assembly, the drive assembly comprising a guide trolley and a winch assembly cooperatively configured with one another to winch the guide trolley along the pair of rails;

using the hoisting winch to conveying the conveyor assembly up the drill rig mast;

using the conveyor assembly to align the drill rod relative to a drill string; and, using the drill rotation head and/or the spinner to attach an end of the drill rod to an end of a drill string.

18. The method as recited in claim 17, wherein the method is fully automated using a controller adapted to receive information from one or more of: an encoder fitted to the drive assembly of the conveyor assembly, speed and/or direction sensors fitted to the hoisting winch of the drill rig, and/or an inclinometer fitted to the drill rig mast.

19. A method for conveying a drill rod to and/or from a drill rig, the drill rig including a drill rod mast, hoisting winch and a spinner, the method comprising:

aligning a conveyor assembly relative to an end of a drill string or drill rod such that a hoist assembly centreline of the conveyor assembly is disposed coaxial with a centreline defined by the drill string or drill rod; the conveyor assembly comprises a linkage assembly and a drive assembly cooperatively configured with one another to drive the linkage assembly, and the drive assembly comprises a guide trolley and a winch assembly cooperatively configured with one another to winch the guide trolley along a pair of rails;

coupling the drill string or drill rod to the hoist assembly of the conveyor assembly;

using the hoisting winch to convey the conveyor assembly and drill string or drill rod up the drill rig mast;

using the spinner to separate or attach a portion of the drill string or drill rod to or from the drill string using the spinner; and clamping or unclamping an end of the drill string.

20. The method as claimed in claim 19, wherein the method is fully automated using a controller adapted to receive information from one or more of: an encoder fitted to the drive assembly of the conveyor assembly, speed and/or direction sensors fitted to the hoisting winch of the drill rig, and/or an inclinometer fitted to the drill rig mast.

* * * * *